United States Patent [19]

Jeanneret

[11] Patent Number: 4,749,022

[45] Date of Patent: Jun. 7, 1988

[54] FOUNDRY GATING SYSTEM

[75] Inventor: Miguel J. Jeanneret, Santiago, Chile

[73] Assignee: Marie-Therese Simian, Santiago, Chile

[21] Appl. No.: 936,113

[22] Filed: Nov. 28, 1986

[51] Int. Cl.[4] ..... B22C 9/08

[52] U.S. Cl. ..... 164/358; 164/359; 164/362

[58] Field of Search ..... 164/134, 358, 359, 360, 164/362, 363, 349, 133

[56] References Cited

U.S. PATENT DOCUMENTS

| | | | |
|---|---|---|---|
| Re. 31,972 | 8/1985 | Nieman et al. | 164/362 |
| 481,295 | 8/1892 | Black | 164/367 |
| 944,370 | 12/1909 | Monnot | 164/450 |
| 974,218 | 11/1910 | Wells | 164/399 |
| 1,100,831 | 6/1914 | Kline | 164/358 |
| 1,188,938 | 6/1916 | Horner | 164/358 |
| 1,323,583 | 12/1919 | Earnshaw | 164/124 |
| 2,096,707 | 10/1937 | Campbell | 164/134 |
| 2,835,007 | 5/1958 | Hoefer | 164/358 |
| 2,840,871 | 7/1958 | Gaffney | 164/134 |
| 3,080,628 | 3/1963 | Sundin | 164/134 |
| 3,111,732 | 11/1963 | Schroer et al. | 164/134 |
| 3,268,958 | 8/1966 | Sickbert | 164/466 |
| 3,433,293 | 3/1969 | Ponzar | 164/358 |
| 3,566,954 | 3/1971 | Gamble et al. | 164/440 |
| 3,572,421 | 3/1971 | Mezey et al. | 164/237 |
| 3,680,628 | 8/1972 | McLean | 164/362 |
| 3,682,435 | 8/1972 | Lofberg et al. | 249/204 |
| 3,746,078 | 7/1973 | Moore et al. | 164/363 |
| 4,154,289 | 5/1979 | Jeanneret | 164/358 |
| 4,368,834 | 1/1983 | Daussan et al. | 164/134 |

FOREIGN PATENT DOCUMENTS

| | | | |
|---|---|---|---|
| 0060349 | 9/1982 | European Pat. Off. | 164/359 |
| 419386 | 10/1925 | Fed. Rep. of Germany . | |
| 1280495 | 10/1968 | Fed. Rep. of Germany . | |
| 417403 | 1/1947 | Italy . | |
| 50-33541 | 9/1975 | Japan . | |
| 51-19618 | 5/1976 | Japan . | |
| 52-1850 | 1/1977 | Japan . | |
| 41053 | 3/1925 | Norway . | |

OTHER PUBLICATIONS

Holzmuller, "Die Anschnittechnik in Steigereingussverfahren," *Giesserei*, 16:20 (1958), pp. 545–551.

*Handbuch der Giesserei—Technik*, Roll (ed.), Springer-Verlag, Berlin 1970, pp. 930–952.

*Primary Examiner*—Nicholas P. Godici

*Assistant Examiner*—Richard K. Seidel

*Attorney, Agent, or Firm*—Oblon, Fisher, Spivak, McClelland & Maier

[57] ABSTRACT

A gravity poured foundry mold having a gating system and at least one complete mold casting cavity, the gating system allowing castings to be made in more compact molds, using less metal at lower temperature, obtaining less solidification strained castings, and requiring less fettling work and less pattern work. The gating system combines the use of a strainer such as a skin-strainer with any of several fluid restraining devices including but not limited to skin-strainer covers, restraining floating pieces, non-floating restraining pieces and blind floating pieces. Also disclosed are applications in which a skin-strainer is omitted. There is disclosed apparatus which may be standardized, thereby greatly increasing the ease, accuracy and confidence with which the gating system may be used in foundries which would have available to them sets of different sizes of standardized, interchangeable and prefabricated elements as disclosed herein. Also disclosed is a combination of this gating system with in-mold metallurgical treatment. The gating system may include a straining device at the casting skin level and or one or more straining devices at upstream levels in a sprue-feeder.

30 Claims, 12 Drawing Sheets

FOUNDRY GATING SYSTEM

BACKGROUND OF THE INVENTION

1. Field of the Invention

The invention relates to a gravity poured foundry mold and, in particular, to a gating system for such a mold.

2. Discussion of the Background

In common foundry practice, the flow of metal in a gravity poured mold is controlled by a gating system so as to produce one or more castings. Once the mold is full, the gating system, if properly designed, promotes good directional solidification of the casting or castings produced with that mold. Such molds may be made, for example, of sand, of graphite, or of a metallic-based material. They also may be based on any other material or combination thereof, so long as the metal being poured is compatible with the refractoriness of those materials and with the refractoriness of other materials used in the mold.

It has been known to use a skin-strainer in the gating system of a mold. Such skin-strainers are disclosed generically and in several specific embodiments in U.S. Pat. No. 4,154,289, the disclosure of which is hereby incorporated by reference.

FIG. 1 shows a mold in its pouring position comprising one mold casting cavity 1, and an embodiment of a skin-strainer 2 located somewhere along the top 3 of the mold casting cavity surface and preferably being located at those points requiring a traditional riser or feeder. Above the skin-strainer 2 is a conduit 5 which, in the illustrated embodiment, is a sprue-feeder extending to the top surface 4 of the mold. The sprue-feeder 5 communicates with mold casting cavity 1 through apertures 6 in skin-strainer 2, the apertures 6 collectively comprising the total passage cross-sectional area of the skin-strainer.

Although different molding practices may be used according to which a skin-strainer 2 may be located along the bottom or side surfaces of the mold casting cavity, the most natural and advantageous location is the surface of the casting cavity 1 which is on top when the mold is in pouring position. The skin-strainer 2 is firmly held in position at the lower end of the sprue-feeder 5 using retaining means 7 embedded in the top of part 8 of the mold. In the particular case of FIG. 1, the top of part 8 of the mold is made of bonded sand, the skin-strainer 2 is ceramic and the retaining means 7 is metallic. Other materials may be used, provided the refractoriness of those materials is compatible with the temperature of the metal being poured.

To fill the mold casting cavity 1, melted metal is poured directly into the sprue-feeder 5, first at a rate which is sufficient to quickly fill a major portion of the sprue-feeder, thereby choking the sprue-feeder, and then at a lower rate which is sufficient to keep the level of metal in the sprue-feeder substantially constant while the mold casting cavity 1 is being filled through the apertures 6. As shown, the apertures 6 may advantageously have tapered side walls.

A mold having a gating system comprising one or more skin-strainers 2 generally allows for the production of good quality castings at a lower cost than other traditional gating systems. However, choosing the size of the apertures 6 and the total passage cross-sectional area of the skin-strainer presents a conflict. On the one hand, the apertures must be sufficiently small to allow for easy choking of the sprue-feeder during pouring and to avoid the passing of melt inclusions through the apertures 6 into the mold casting cavity. On the other hand, the passage are must be large enough to allow not only for good filling of the cavity but also, and when necessary, for good feeding of the casting during its solidification.

SUMMARY OF THE INVENTION

Accordingly, it is an object of the current invention to eliminate the above-noted conflict in the design of a skin-strainer while retaining the other advantages which are involved in the use of skin-strainers and by providing additional advantages.

Additional objectives of the current invention are to provide a gating system for a foundry mold having straining means and providing additional advantages including the following:

1. To control to any required degree the flow of molten metal entering the mold casting cavity of any gravity poured foundry mold, making such flow as rapid or slow as required for good filling of the cavity.

2. To avoid the entry of detrimental melt inclusions into the mold casting cavity.

3. To assure, when necessary, the feeding of the casting in order to obtain the desired directional solidification of the casting.

4. To provide a gating system having a minimum volume, thereby allowing the pouring of more molds per melt batch.

5. To reduce gating system pattern work to a very minimum.

6. To minimize the fettling operations that arise from the design of the gating system, thereby minimizing the amount of post-casting work required and providing a neater as-cast appearance of the casting.

7. To reduce molding costs by providing a more compact gating system which allows the use of smaller and cheaper molds and which also allows more molds in the same molding shop area.

8. To reduce internal stresses and deformations associated with solidification and cooling of the casting by minimizing the connections between the casting and the gating system.

9. To permit a very quick filling of the mold casting cavity, thereby allowing pouring to occur at a lower melt temperature, which saves heating energy, avoids dissolved gases in the metal, decreases the importance of metal shrinkage, and provides additional advantages.

The current application discloses three generic types of restraining means for assisting the choking of the conduit 5 by restraining the flow of metal through the total cross-sectional passage area at at least one point between the outside surface of the mold and the mold casting cavity. Typically, although not always, the restaint is temporary and promotes the choking of the conduit during pouring. In every case, some structural means are provided for assuring proper feeding of the casting.

The restraining means may take the generic forms of a cover, a restraining floating piece, and a non-floating restraining piece. Each of these generic types of restraining means may be used by itself or in combination with the others, and more than one restraining floating piece and non-floating restraining piece may be used in association with the same skin-strainer.

The cover comprises at least a main body and a handle, the main body being insertable into the conduit and having a bottom surface configured to close off, at least partially, the total flow area available for the passage of molten metal from the conduit 5 into the cavity 1. The combined effects of the diminished flow area and the volume of the cover facilitate the choking of the conduit 5. When the conduit 5 is filled sufficiently, the handle is used to remove the cover from the conduit 5, thereby permitting the flow of molten metal into the mold casting cavity 1 through an increased flow area. At such time, the conduit may be kept choked by increasing, as necessary, the flow rate of metal being poured up to the moment that the mold casting cavity is full.

Restraining floating pieces also may be used in order to temporarily restrict the available flow area from the conduit into the cavity. The restraining floating pieces may be used instead of a cover or, in the alternative, may be used together with a cover.

One or more restraining floating pieces are initially disposed in the aperture means between the conduit and the cavity. In most embodiments, a restraining floating piece does not completely block the flow area of any given aperture. When the mold casting cavity is full, the restraining floating piece will float, thereby restoring the original open area of the aperture in which the piece had been disposed, such that the entire original area is available for proper feeding of the casting.

When one or more restraining floating pieces is used simultaneously with a cover, the restraining floating piece may be disposed in an aperture covered by the cover or in an aperture not covered by the cover, or a restraining floating piece may be disposed in both such locations.

Quite often, in skin-strainer applications, the casting surface (i.e., the surface of the mold casting cavity) may be modified without detrimental effect on the casting but favoring the application of a skin-strainer. Similar modifications may be made when also using the restraining means according to the current invention. Examples of such modifications are illustrated in FIGS. 2 and 3.

FIG. 2 shows a skin-strainer 2 located along a modified mold casting cavity surface 9, which defines a volume modification 10 of the mold casting cavity 1. In FIG. 2, the volume modification extends upwardly. FIG. 3 shows a similar volume modification which extends sideways.

At least to some degree, the advantages achieved by using restraining means according to the current invention may be realized in the absence of a skin-strainer. When a skin-strainer is used, the use of the restraining means makes the application of a skin-strainer and its advantages more universal within foundry molding practice.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
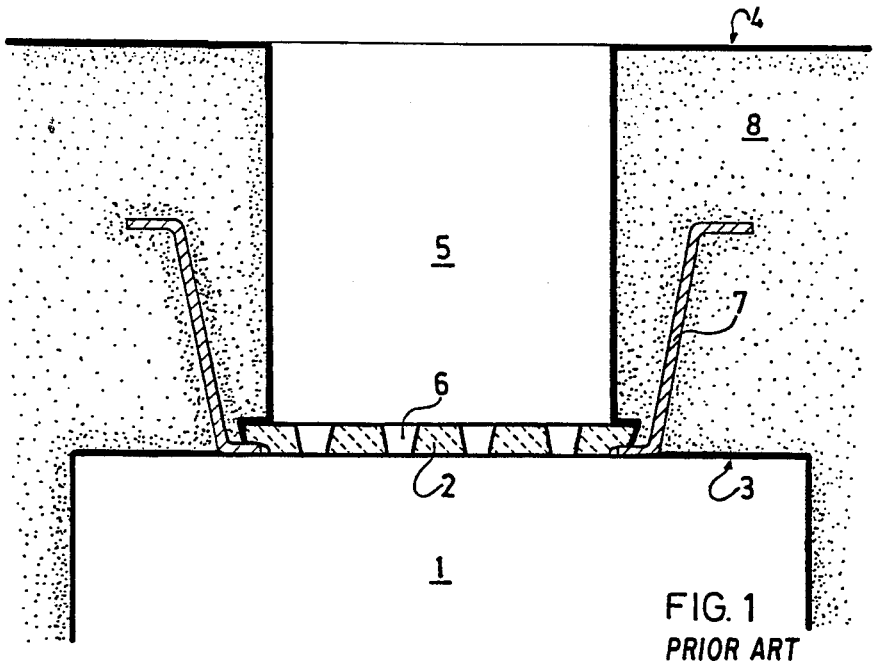
FIG. 1 PRIOR ART
FIG. 1 is a vertical cross-section showing a first embodiment of a skin-strainer interposed between a mold casting cavity and a sprue-feeder.

The following definitions shall apply throughout the disclosure and the claims:

A "metal" is a pure metal or an alloy.

A "melt" is a batch of molten metal.

A "casting" is a metal object cast to a desired shape by pouring or injecting, or both, liquid metal into a mold, as distinct from a metal object shaped by a mechanical process.

A "gravity mold" is any foundry mold designed to be filled with molten metal only under the effect of gravity. Most usually, once the different parts of a gravity mold are made, the position in which the mold is closed, i.e., the position in which the different parts of the mold are assembled, is the same position in which the mold is poured. Nevertheless, and as is well known, a gravity mold may also be closed in one position and then rotated into a different pouring position.

An "inclusion" is a particle of impurity, usually non-metallic and not dissolved in the molten metal. An impurity is generally lighter than the metal and is desirably separated from the metal before the metal reaches the mold casting cavity.

A "sprue" is the first conduit, usually vertical in the case of a traditional gravity mold, through which the metal enters the mold.

A "riser" or "feeder" is a reservoir connected to the casting so as to provide liquid metal to the casting during solidification, to offset shrinkage which takes place when the casting solidifies.

"Fettling", also called "foundry finishing operation" or just "finishing" is the process of removing the complete gating system and flashes from the casting after the mold is poured and shaked out, and the carrying out of any necessary operation such that the casting is dimensioned and shaped in accordance with a casting drawing, sample, pattern or any agreement with the customer ordering the casting.

The "mold casting cavity" is the empty part of the mold which corresponds to the complete casting to be produced within that mold, the casting shape being defined in accordance with a sample, a casting drawing, a pattern or any other procedure. Sometimes a modification of the casting surface, and consequently of the casting and of the corresponding mold casting cavity, may be introduced in the foundry for different reasons. Such modifications may be such as either are accepted by the casting customer or eliminated by the foundry at the fettling stage or later at the machine shop. In any case, if a skin-strainer is located along that modified casting surface, the correspondingly modified mold casting cavity is the one described in the disclosure and claims herein by the phrase "mold casting cavity" or just "cavity".

A "sprue-feeder" is a conduit acting both as a sprue and as a feeder. Previously, a sprue-feeder has been considered unsuitable for producing a good quality casting. However, a good quality casting may be made using a sprue-feeder as disclosed herein.

The term "gating system" includes the traditional complete assembly of sprues, runners, ingates, vents, flow-offs, feeders and the like necessary to pour and produce a good casting.

"Restraining means" is means cooperating with an opening to restrain (i.e., to block or restrict) flow through an opening, and comprising one or more elements distinct from the material in which the opening is found. The degree of restraint may be total or less than total.

A "skin-strainer" is a straining means which includes a skin-strainer as disclosed herein and as disclosed generically and in several specific forms in U.S. Pat. No. 4,154,289. In that U.S. patent, the skin-strainer is identified in the several views by any of reference numerals 20, 34 and 35.

"Feeding" is the effect produced by a feeder.

"Directional solidification" describes the solidification of molten metal in a mold casting cavity such that feeding metal is always available for that portion of the casting that is just solidifying.

"Refractoriness" is the ability of a material to withstand high temperatures as, for example, contact with molten metal. In the foundry art, the refractoriness of a material is a relative term and depends upon the metal being melted and poured to produce castings, as different foundry metals melt at temperatures over a widely varying range.

When a metal having a low melting point is being poured, a wide variety of materials exhibit refractoriness, including other metals having higher melting points. As the melting point of the metal being poured increases, the range of materials exhibiting refractoriness is reduced and may ultimately include only some metals properly protected with an adequate refractory wash or one of those materials usually referred to as "refractory materials" or just ceramics, including all solid industrial materials that are neither metallic nor organic, which are highly heat resistant and have low thermal conductivity, whether in a granulated or powdered form. Refractory materials may be given many different shapes by using a bond that may be mechanical, physical, chemical, sintered, a combination of the above, or any other type of bond.

When an accessory or part is required to be mechanically strong and have a high heat resistance, it is known in the art to associate the use of refractory material with metal in combined form or the use of a cermet, which involves the technique of bonding a ceramic with a metal.

Figure 4:
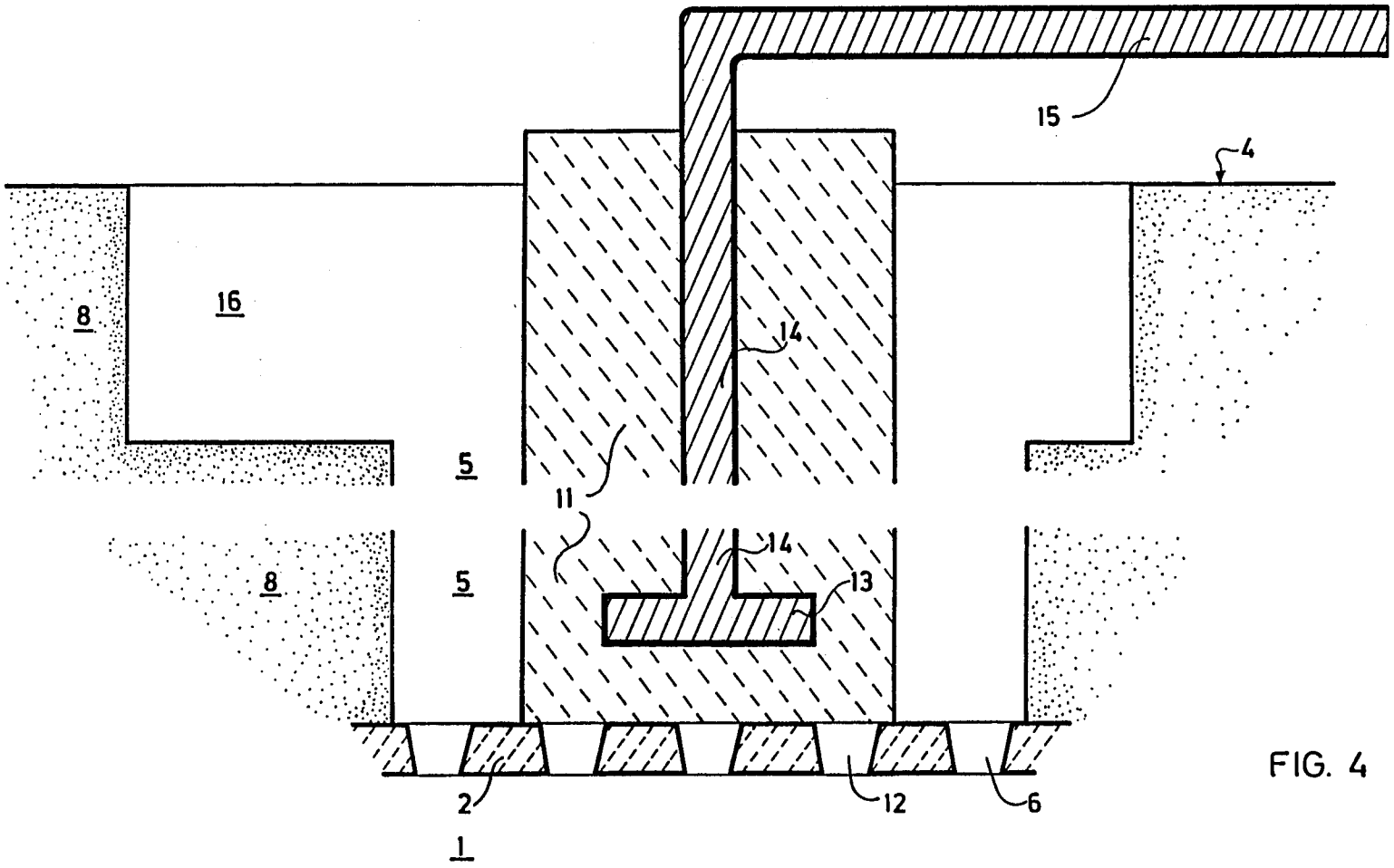
FIG. 4 is a broken vertical cross-section showing a first embodiment of a cover according to the current invention, the cover being a skin-strainer cover cooperating with a skin-strainer and being disposed in a sprue-feeder, the sprue-feeder being provided with a sprue-feeder enlargement.

Referring now to the drawings, wherein like reference numerals designate identical or corresponding parts throughout the several views, and more particularly to FIG. 4 thereof, there is shown a part of a skin-strainer 2 disposed between sprue-feeder 5 and mold casting cavity 1, the skin-strainer 2 having therein a plurality of apertures, the horizontal cross-sections of which collectively comprise the total cross-section passage area of the skin-strainer 2. The sprue-feeder 5 passes upwardly through the top of part 8 of a mold to the top surface 4 of the mold.

Also shown in FIG. 4 is a skin-strainer cover including a body 11, the bottom surface of the body 11 being in contact with the top surface of skin-strainer 2 so as to block a fraction of the total cross-sectional passage area formed by the apertures of the skin-strainer. Apertures 12 are covered by the skin-strainer cover, while additional apertures 6 are not covered by the skin-strainer cover.

In the embodiment shown in FIG. 4, the skin-strainer cover body 11 may advantageously be made of a refractory material. A handling means is partially embedded in the body 11 and comprises an anchoring form 13, a connecting bar 14 and a handle 15. The handling means can be made by forging, welding or any other suitable and known procedure.

If desired, an enlargement 16 may be formed in sprue-feeder 5 to provide an additional volume than would otherwise be provided by the lesser diameter of the lower portion of the sprue-feeder. Also, such an enlargement 16 makes it easier to choke sprue-feeder 5.

When the mold is ready to be cast and with the skin-strainer cover held in position as shown, as by handle 15, molten metal is poured either into the enlargement 16, or directly into sprue-feeder 5, quickly enough to choke the sprue-feeder. The first metal begins to pass through apertures 6 into cavity 1. When a proper level of molten metal is achieved in sprue-feeder 5, or in enlargement 16 if present, the skin-strainer cover is lifted and removed from the sprue-feeder. Similtaneously, pouring is increased in order to keep the sprue-feeder 5 choked. The pouring continues until the molten metal starts rising, thereby indicating that the mold casting cavity is full. Pouring is then stopped. Of course, if when pouring is completed the level of the metal in sprue-feeder 5 finishes too low and becomes insufficient for a proper feeding of the casting, the necessary difference of metal is added.

While the mold is being poured, venting of the cavity 1 cannot be accomplished properly through the choked sprue-feeder 5. Therefore, any known venting method should be used such that the gases in the mold casting cavity 1 are pushed outside while the molten metal is rising in the cavity.

Figure 5:
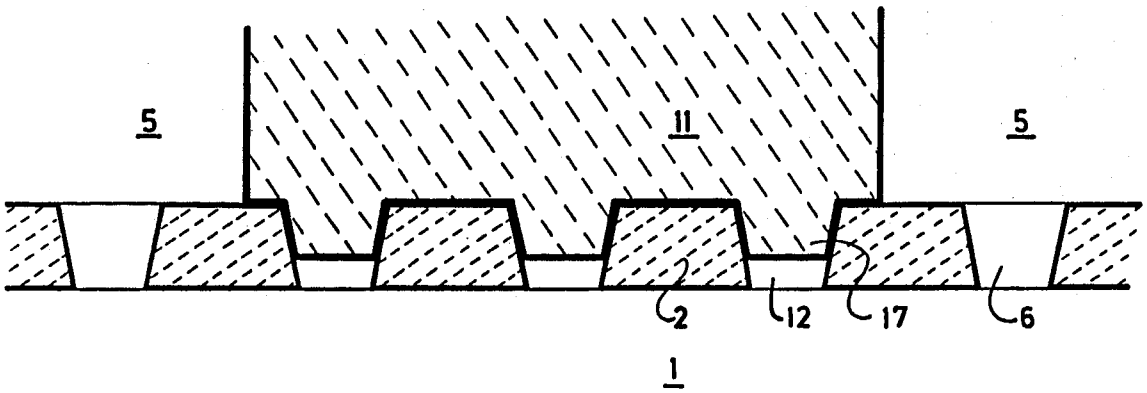
FIG. 5 is a vertical cross-section illustrating a fragment of FIG. 4 and showing a modification of the bottom of the skin-strainer cover to form a second embodiment of a cover according to the current invention.

FIG. 5 shows a second embodiment of a skin-strainer cover which provides improved mating between skin-strainer cover body 11 and skin-strainer 2. The bottom surface of the skin-strainer cover body 11 is provided with a plurality of plug-like penetrations 17 which fit within those apertures 12 of the skin-strainer which are blocked by the skin-strainer cover. The shape of the apertures of the skin-strainer 2 may be modified to promote the mating of the surfaces, for example, by modifying the taper of the apertures 12 or defining any other suitable shape for the apertures 12.

Figure 6:
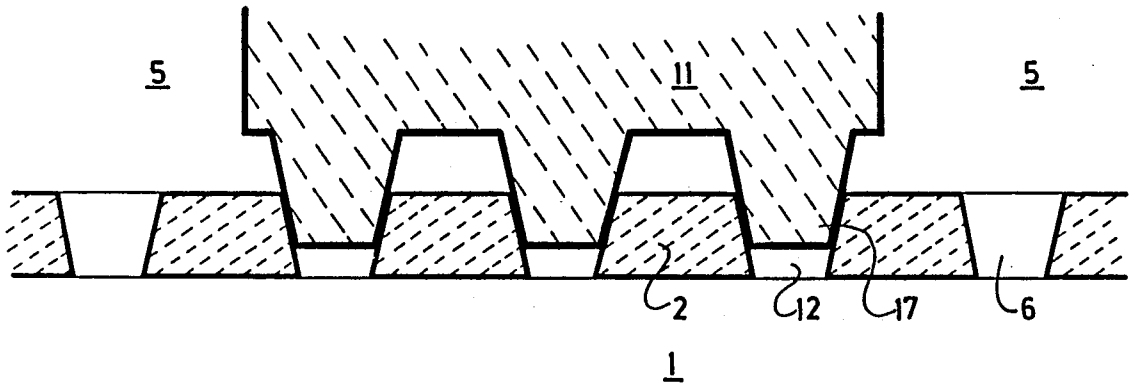
FIG. 6 is a vertical cross-section of a fragment of FIG. 4 showing a different modification of the bottom of the skin-strainer cover to form a third embodiment of a cover according to the current invention.

*FIG. 6 illustrates a third embodiment in which the* upper surface of the skin-strainer 2 does not contact the bottom surface of the skin-strainer body 11. This embodiment illustrates the fact that, with well-fitting penetrations 17, it no longer is necessary to have such contact between the uppe surface of the skin-strainer 2 and the lower surface of the body 11. In this embodiment, the downward force applied on the skin-strainer cover 11 and against the skin-strainer 2 must balance the upward force on the skin-strainer cover resulting from the molten metal until the moment that the skin-strainer cover is lifted.

Figure 7:
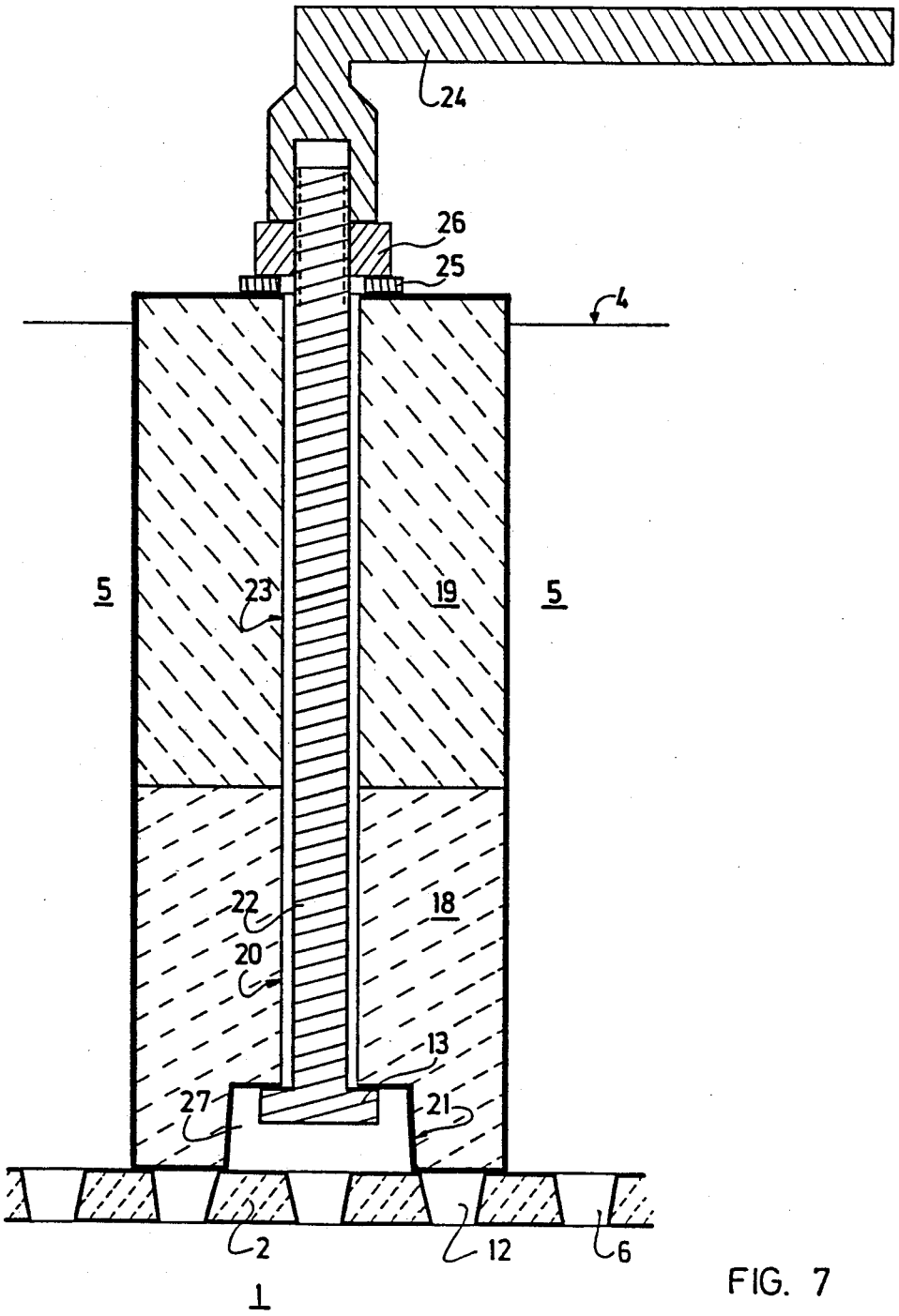
FIG. 7 is a vertical cross-section of a fourth embodiment of a cover according to the current invention.

FIG. 7 illustrates a fourth embodiment of a skin-strainer cover according to the invention in which the skin-strainer cover is formed of standardized parts. The body of the skin-strainer cover comprises at least a bottom standard part 18 and, if required by the length of the sprue-feeder 5, also by one or more auxiliary cover extension parts 19. A longitudinal passage 20 is formed in the bottom standard part 18 and communicates with a recess 21 formed at the bottom of the bottom standard part 18.

Anchoring form 13 of a standardized connecting bar 22 is disposed in recess 21. The standard connecting bar 22 passes through the passage 20 and through corresponding passages 23 of any auxiliary cover standard extension parts 19 that may be present. A standardized handle 24 is connected to the standardized connecting bar 22 as, for example, by using a threaded fastener. The threaded fastener may be formed by a thread at the upper end of the standardized connecting bar 22, a washer 25 and a nut 26, this threaded fastener additionally permitting the tightening of the entire skin-strainer cover as a whole.

The anchoring form 13 may be square or hexagonal in cross-section, and recess 21 may desirably be large enough to permit the introduction into recess 21 of a tube wrench for facilitating the tightening of the skin-strainer cover as a hole. Following the assembly of the skin-strainer cover, and if recess 21 is larger than necessary for accommodating the anchoring form 13, the recess 21 may be filled with a refractory mix 27 so as to avoid contact between the molten metal and the anchoring form 13 during the stage when the skin-strainer cover is lifted upwardly within the sprue-feeder 5.

The bottom standard part 18 and auxiliary extension standard parts 19 may be made of any suitable refractory material, applying any known manufacturing procedure for making parts with such materials. The metallic standard parts also may be made by known procedures.

Advantageously, the skin-strainer cover may be held in place against the skin-strainer 2 during pouring by hand and lifted at the right moment during pouring. However, for big castings it may be easier or even necessary to provide other means for lifting to assure both proper initial holding in place during pouring and the subsequent lifting operation.

The skin-strainer cover is in contact with the molten metal for a comparatively short time, usually a matter of seconds. Accordingly, if the body of the skin-strainer cover is made of a material with a sufficiently high degree of refractoriness, the cover typically will be reusable for the pouring of several or even many molds.

In the embodiments of FIGS. 4–7, the total passage cross-sectional area of the skin-strainer should be at least the minimum necessary both for adequate filling of the cavity 1 during pouring and also for adequate feeding of the casting following pouring. However, there will now be described additional embodiments according to the current invention in which one or more restraining floating pieces, or one or more non-floating restraining pieces, or both, are employed as restraining means. Such restraining means partially block the apertures in which they are disposed, thereby creating a restricted cross-sectional passage area presented by the assembly of the skin-strainer and the restraining pieces disposed therein. Accordingly, the total passage cross-sectional area of the skin-strainer 2 itself, considered alone, will be greater than the minimum necessary for adequate filling of the cavity 1.

Figure 8A:
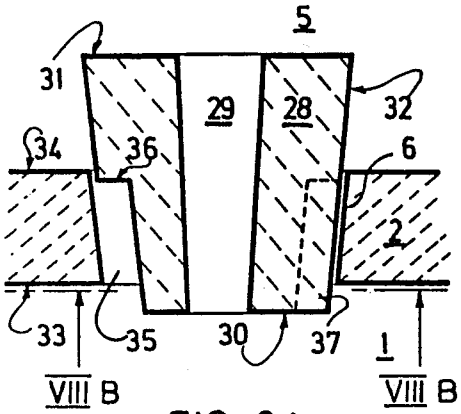
FIG. 8A is a vertical cross-section showing a first embodiment of a restraining floating piece according to the current invention, the piece being disposed in an aperture of a skin-strainer and being shown elevated slightly above its usual position during pouring for purposes of illustration.
Figure 8B:
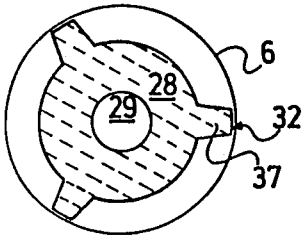
FIG. 8B is a horizontal cross-section taken on line VIIIB—VIIIB of FIG. 8A.

FIGS. 8A and 8B respectively show vertical and horizontal cross-sections of restraining floating piece 28 according to the current invention. The restraining floating piece 28 is disposed in aperture 6 of skin-strainer 2 and has a lower surface 30, an upper surface 31 and an external lateral surface 32. Passage 29, formed in the restraining floating piece, communicates sprue-feeder 5 with mold casting cavity 1. Because of the presence of passage 29, the restraining floating piece only partially blocks the aperture 6 of skin-strainer 2.

For purposes of illustration, the restraining floating piece is shown slightly elevated above its actual position during pouring, at which time lateral surface 32 contacts the lateral wall of aperture 6. When the restraining floating piece of FIGS. 8A and 8B is in its position for pouring, surface 30 will be lower than lower surface 33 of skin-strainer 2, and surface 31 of the restraining floating piece will be higher than upper surface 34 of skin-strainer 2.

Recesses 35 are formed around the lower portion of the restraining floating piece and are interrupted by tooth-like projections 37, hereinafter called teeth. The radially-outer surfaces of the teeth 37 are coincident with the lateral surface 32 of the restraining floating piece and therefore also contact the wall of the aperture 6. Preferably, three such teeth 37 are provided.

The upper surfaces 36 of the recesses 35 are disposed at a level above that of lower surface 33 of skin-strainer 2 and lower than that of upper surface 34 of skin-strainer 2 when the restraining floating piece is in its pouring position.

Although other shapes may be used, in the illustrated embodiment the aperture 6 is shown as circular, the restraining floating piece 28 is generally annular, and the bottom surface 33 of skin-strainer 2 is flat.

During the pouring of metal into the sprue-feeder 5, the restraining floating piece serves to restrict the area of apertures 6, reducing the now available cross-sectional are to that created by passage 29. When mold casting cavity 1 is full, the restraining floating piece 28 floats, thereby increasing the effective cross-sectional area that is now available for feeding of the casting.

The ability of restraining floating piece 28 to float depends upon a number of factors including the weight of the restraining floating piece, the buoyant force acting on the restraining floating piece that results from the weight of the molten metal displaced thereby under the Pascal principle, and the fact that a portion of surface 32 is in contact with wall 6 and therefore is not initially available for being urged upwardly by molten metal in the cavity 1 after the cavity 1 is filled.

In order to ensure that the balance of forces acting on restraining floating piece 28 results in a net upward buoyant force, a number of factors in addition to the weight of the piece may be considered. In particular, to increase buoyancy, the level of surface 36 may be made as near as possible to that of surface 34, the number of teeth 37 may be made as few as possible, the slope of the wall of aperture 6 may be as nearly vertical as possible, the level of surface 30 may be as low as necessary or as permitted by the mold casting cavity 1, and the level of surface 31 may be as high as necessary. Naturally, the weight of the restraining floating piece will be a function of its composition.

Figure 9A:
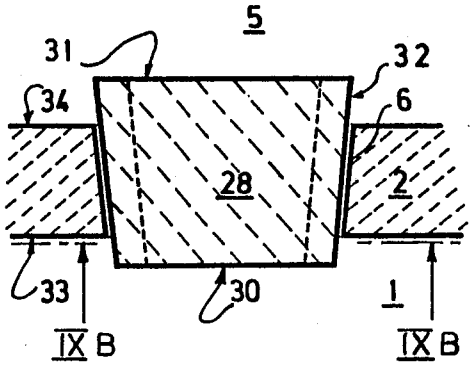
FIG. 9A is a vertical cross-section of a second embodiment of a restraining floating piece according to the current invention, the piece being disposed in an aperture of a skin-strainer and being shown slightly elevated above its normal position during pouring for purposes of illustration.
Figure 9B:
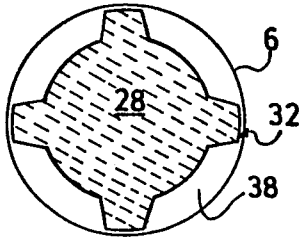
FIG. 9B is a horizontal cross-section taken on line IXB—IXB of FIG. 9A.

FIGS. 9A and 9B respectively show vertical and horizontal cross-sections of a second embodiment of a restraining floating piece according to the current invention. Instead of a passage 29, the restraining floating piece is configured such that a number of passage 38 are formed when the piece is inserted into the aperture 6, the passages extending along the entire height of the external surface 32 of the restraining floating piece, the passages communicating the sprue-feeder 5 and the cavity 1. Again, the restraining floating piece is shown slightly elevated above its pouring position for purposes of illustration. Bottom surface 30 of the restraining floating piece is disposed at a level below that of bottom surface 33 of skin-strainer 2. Upper surface 31 of the restraining floating piece is shown disposed at a level above that of top surface 34 of skin-strainer 2, but it may be desirable for surface 31 and surface 34 to be coincident, depending upon any desired degree of blockage that may be provided by a cover, if a cover is used to cover that particular restraining floating piece.

Figure 10A:
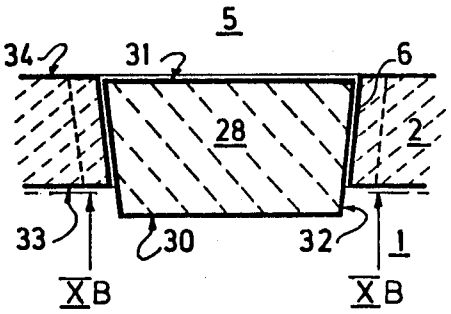
FIG. 10A is a vertical cross-section showing a third embodiment of a restraining floating piece according to the current invention, the piece being disposed in an aperture of a second embodiment of a skin-strainer, the piece being shown slightly elevated above its normal position during pouring for purposes of illustration.
Figure 10B:
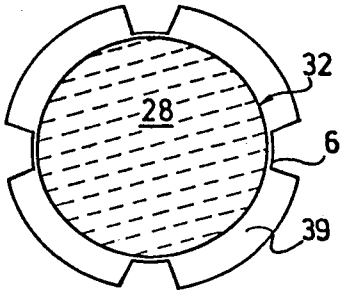
FIG. 10B is a horizontal cross-section taken on line XB—XB of FIG. 10A.

FIGS. 10A and 10B respectively show vertical and horizontal cross-sections of a third embodiment of a restraining floating piece according to the current invention. Also shown is a second embodiment of a skin-strainer. The restricted passage cross-sectional area of the aperture 6 is provided by grooves 39 formed in the sidewall of the skin-strainer aperture, passing entirely through the thickness of the skin-strainer. Accordingly, no passages need be incorporated into the construction of the restraining floating piece itself.

Again, the restraining floating piece is shown for purposes of illustration elevated somewhat above its position for pouring. In the pouring position, the bottom surface 30 of the restraining floating piece is at a level below the bottom surface 33 of skin-strainer 2, and surface 31 is disposed at a level lower than that of surface 34.

Additional embodiments may be created by combining teachings from various ones of the illustrated embodiments.

Figure 11:
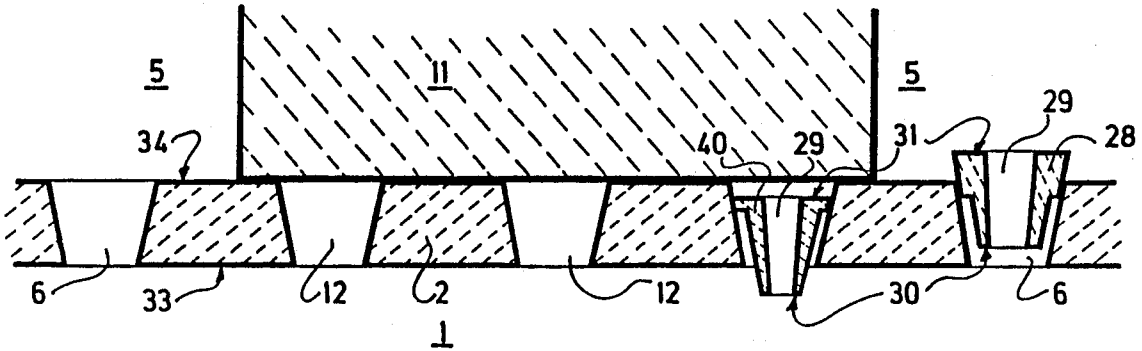
FIG. 11 is a vertical cross-section showing two restraining floating pieces disposed in respective aperatures of a skin-strainer, one restaining floating piece being covered by a skin-strainer cover and the other restraining floating piece not being so covered.

FIG. 11 illustrates the use of two restraining floating pieces in combination with a skin-strainer cover. However, any number of restraining floating pieces may be used, and more than one embodiment may be used at the same time. In addition, the restraining floating pieces may be used without the assistance of a skin-strainer cover.

For purposes of illustration, there is shown a restraining floating piece 40 disposed in an aperture 12 which is covered by the skin-strainer cover body 11 and a restraining floating piece 28 disposed in an aperture 6 of skin-strainer 2 which is not covered by skin-strainer cover body 11. Pieces 28 and 40 are shown as modifications of the embodiment of FIGS. 8A and 8B. Piece 28 is modified by raising its lower surface 30 above the bottom surface 33 of the skin-strainer, whereas the piece 40 is modified such that its upper surface 31 is below the level of top surface 34 of skin-strainer 2. It should be noted that passage 29 of piece 28 will be available for communicating sprue-feeder 5 with cavity 1 immediately upon the initiation of pouring, whereas passage 29 of piece 40 will not be available for such communication until the skin-strainer cover is lifted.

The upper surface 31 of the one or more restraining floating pieces disposed in the apertures 12 covered by the skin-strainer may also be disposed at the level of top surface 34 of the skin-strainer or even above the level of surface 34 of the skin-strainer so long as the bottom of the skin-strainer cover body 11 is effective to cover the holes 29. For example, when the bottom of the skin-strainer cover body 11 is flat, as shown, the upper surfaces 31 of the restraining floating pieces disposed in the apertures 12 may lie in a common plane with the bottom of the cover body 11.

Figure 12:
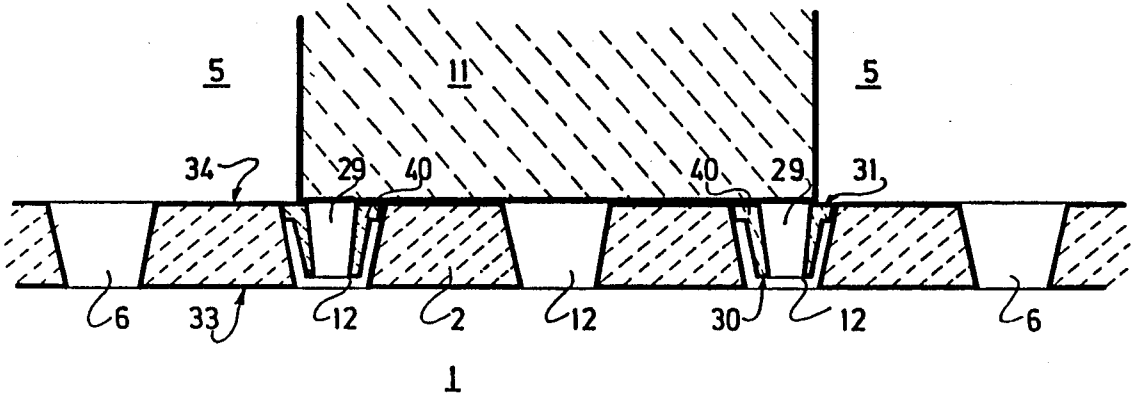
FIG. 12 is a vertical cross-section illustrating a reduction in size of a skin-strainer cover over that in FIG. 11 when using restraining floating pieces disposed within apertures of the skin-strainer that are covered by the skin-strainer cover.

FIG. 12 illustrates an alternative in which the available volume in sprue-feeder 5 is increased by decreasing the size of skin-strainer cover body 11 without decreasing the number of apertures that are covered by the body 11. In particular, restraining floating pieces 40 are disposed with their upper surfaces 31 even with surface 34, and the size of the body 11 is just sufficient to block the passages 29. As in FIG. 11, there is shown a modification of the restraining floating pieces in which the bottom surfaces 30 thereof are disposed at a level above that of bottom surface 33 of skin-strainer 2.

Figure 13:
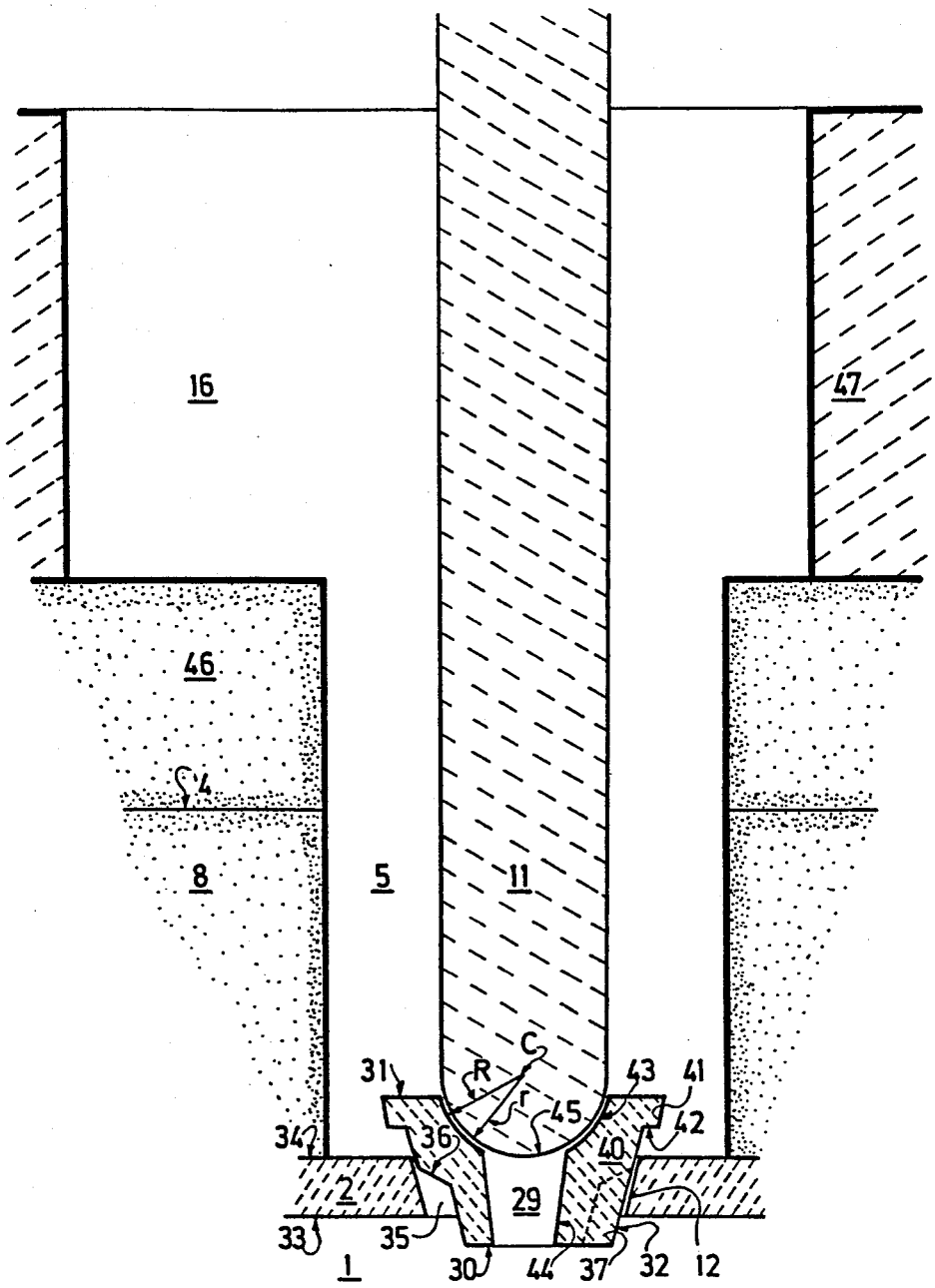
FIG. 13 is a vertical cross-section illustrating a third embodiment of a skin-strainer, the skin-strainer having only a single aperture, a fourth embodiment of a restraining floating piece and a fifth embodiment of a cover, the cover taking the form of a skin-plug, the piece and the cover being shown slightly elevated above their normal positions during pouring for purposes of illustration, as is also the case in FIGS. 14, 15, 19 and 20.

FIG. 13 shows a fifth embodiment of a cover body 11, in the form of a skin-plug, a third embodiment of a skin-strainer 2, and a fourth embodiment of a restraining floating piece.

The skin-strainer 2 has a single aperture 12 which receives restraining floating piece 40. As in a previous embodiment, recesses 35 are interrupted by teeth 37, but upper surfaces 36 of the recesses are inclined for somewhat increasing the volume of the restraining floating piece and its floatability. As before, the restraining floating piece is illustrated somewhat elevated above its position for pouring. In the pouring position, lateral surface 32 contacts the wall of aperture 12. Provided at an upper portion of restraining floating piece 40 is a laterally-extending expansion 41 having a lower surface 42 disposed at a level above the upper surface 34 of skin-strainer 2. Surface 41 enhances the floatability of restraining floating piece 40 by providing an additional surface on which may act the metalstatic pressure of molten metal in sprue-feeder 5.

Restraining floating piece 40 is provided with a passage 29, a portion of which is spherical and has a radius R as shown. The remainder of the passage 29 may advantageously be conic, as shown at 44.

The skin-strainer cover comprises a skin-strainer cover body 11, bottom 45 of which is spherical and has a radius r which is as close as practical to the radius R in order to obtain good mating of surfaces 43 and 45. Advantageously, the center of curvature C of the radii R and r may be disposed at a level above that of upper surface 31 of the restraining floating piece. An advantage of the elevated center of curvature is that the spherical matching surfaces may accommodate some tilt of the skin-strainer cover body without adversely affecting the quality of contact between the surfaces 43 and 45 and, therefore, without adversely affecting the degree to which passage 29 is blocked.

Also shown in FIG. 13, and further complementing the mold, is an optional sprue-feeder extender 46 for increasing the height of the sprue-feeder above the top surface 4 of the mold, when desired. In addition, and further complementing the mold, FIG. 13 further shows an optional sprue-feeder expander 47 for increasing the volume of available molten metal in the sprue-feeder, when desired. Variation are possible. For example, sprue-feeder extender 46 and sprue-feeder expander 47 may be made integrally as one piece, or sprue-feeder expander 47 may be placed directly on the top surface 4 of the mold when the sprue-feeder extender 46 is not desired. Known foundry practice may be used to ensure that the various contacting surfaces of the mold, extender 46 and expander 47 are properly sealed in order to avoid leakage of molten metal.

Modifications of the restraining floating piece 40 also are possible. For example, surface 42 may be lowered and made to rest on surface 34 whenever needed to avoid a wedge effect between the surface of aperture 12 of the skin-strainer 2 and the lateral surface 32 of the restraining floating piece 40. This modification may be accomplished without loosing the floatability of the restraining floating piece 40 by making appropriate adjustments of its dimensions.

In the embodiment of FIG. 13, the skin-strainer cover body 11 completely blocks the passage 29. Accordingly, no molten metal passes into the mold casting cavity 1 before the skin-strainer cover is lifted. This embodiment makes it quite easy for pourers of lower skill to accomplish choking of sprue-feeder 5. It also provides a container of sufficient size that it may be filled, even before lifting of the skin-strainer cover, with a volume of metal that is sufficient to fill the mold casting cavity 1, the other parts of the gating system such as ventings or traditional feeders, and the sprue-feeder 5 itself with the necessary amount of metal for filling the cavity and feeding the corresponding casting. A mark may be placed before pouring on the sprue-feeder expander 47 for indicating a level corresponding to that volume.

After the pouring is accomplished, the skin-strainer cover removed and the cavity 1 filled, the metalstatic pressure of the molten metal acts on surfaces 30, a portion of surface 32, and on the walls of recesses 35 to produce a net upward balance of forces, thereby causing the restraining float piece 40 to float. The piece 40, when it floats, also automatically protects, to some degree, the upper surface of the molten metal in the sprue-feeder 5. In addition, as with the previous embodiments using restraining floating pieces, the exit of the restraining floating piece 40 from the aperture 12 restores the original total passage cross-sectional area of the skin-strainer for proper feeding of the mold casting cavity 1 from the sprue-feeder 5.

In the embodiment of FIG. 13, because the sprue-feeder 5 including the expander 16 contains the total amount of metal needed, the cavity 1 can be filled without additional human intervention, an important advantage in assuring proper operation.

As noted above, this embodiment of a skin-strainer cover body 11 may be just called a skin-plug, inasmuch as it comprises a plug placed near the level of the skin of the casting.

As with the previous embodiments of the restraining floating means, the embodiment of FIG. 13 may be used without the skin-strainer cover, provided that the passage 29 and sprue-feeder 5 are such that the sprue-feeder may be choked easily. In such a case, the spherical surface 43 of the restraining floating piece is not necessary and may be replaced if desired by an extension of the conic surface 44. Also in such a case, sprue-feeder expander 47 typically will be eliminated. The sprue-feeder extender 46 may be kept up if necessary for proper feeding of the mold casting cavity 1.

Figure 14:
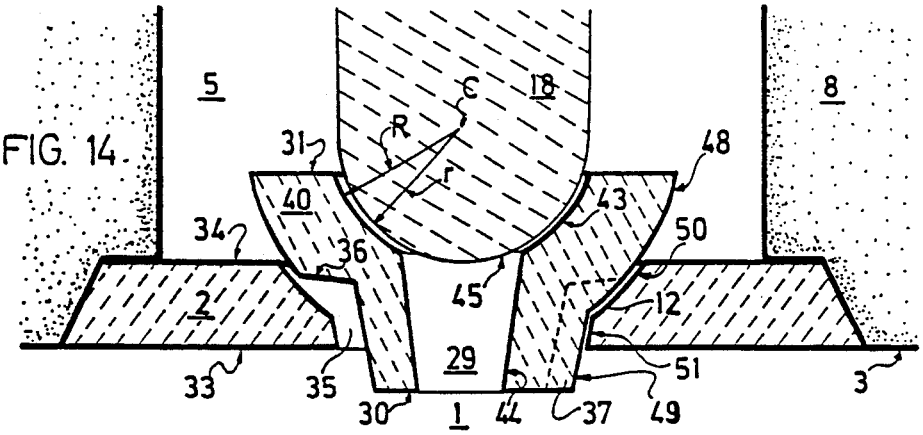
FIG. 14 is a vertical cross-section illustrating a fourth embodiment of a skin-strainer and a fifth embodiment of a restaining floating piece.

FIG. 14 shows a fourth embodiment of a skin-strainer and a fifth embodiment of a restraining floating piece. The embodiment is similar to that of FIG. 13, except that the lateral wall of restraining floating piece 40 comprises a spherical segment 48 and a conic section 49, and the wall of aperture 12 of the skin-strainer is correspondingly formed with a spherical segment 50 and a conic segment 51.

Figure 2:
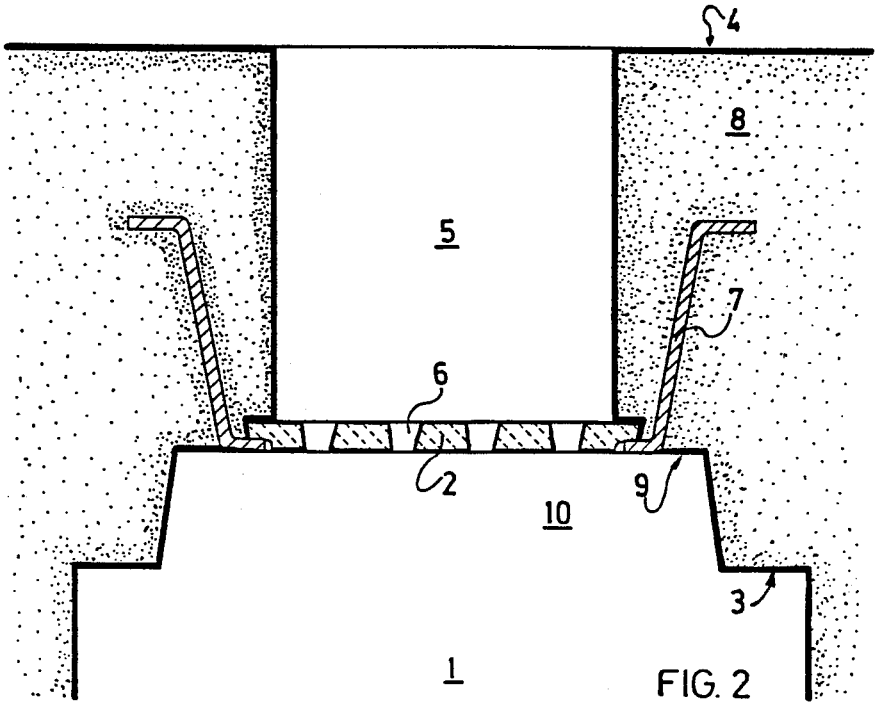
FIG. 2 PRIOR ART
FIG. 2 is a vertical cross-section similar to that of FIG. 1, the mold casting cavity being provided with an upwardly-extending volume modification.
Figure 3:
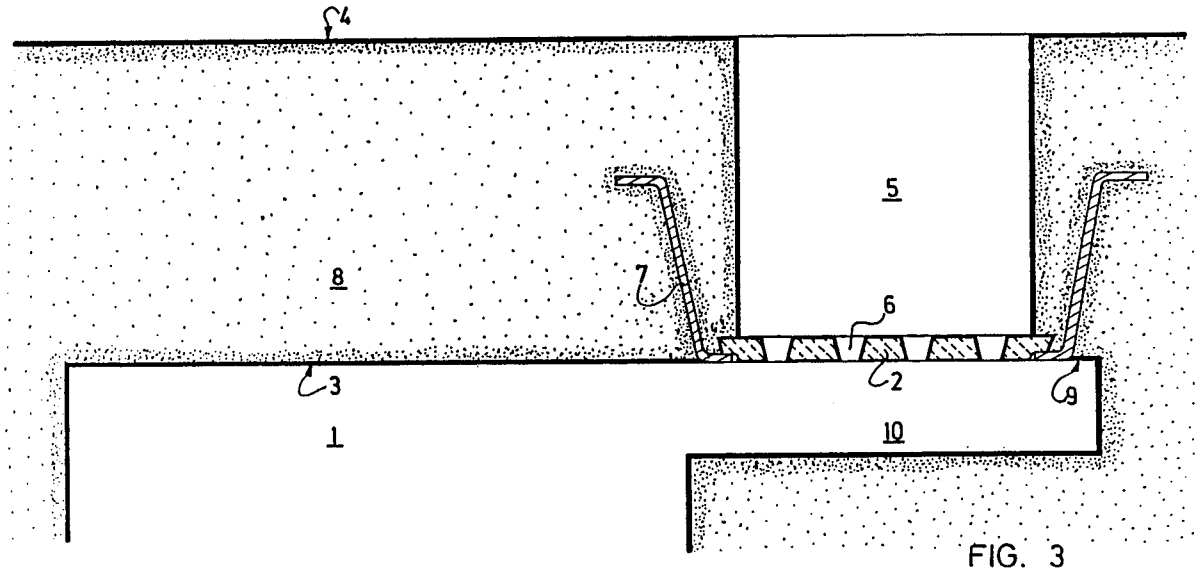
FIG. 3 PRIOR ART
FIG. 3 is a vertical cross-section similar to that of FIG. 1, the mold casting cavity being provided with a volume modification that extends sideways.

It should be noted that the various embodiments disclosed herein may be made of standardized parts which are usable in various combinations, thereby increasing the versatility of the system. Thus, the cover of the embodiments of FIGS. 13 and 14 may be made of standardized parts and constructed similarly to the cover illustrated in FIG. 7, such that the skin-strainer cover body 11 becomes a skin-strainer cover standard bottom part 18. For simplicity of illustration, there is not shown in the drawing elements corresponding to recess 21 and elements 20, 13, 22 and 27 as shown in FIG. 7. FIG. 14 has been further simplified by not showing any necessary skin-strainer retaining means 7 as shown in FIGS. 1–3.

The embodiment of FIG. 14 provides even further versatility with standardized parts, arising from the spherical nature of the matings both between skin-plug 18 and restraining floating piece 40, and between restraining floating piece 40 and skin-strainer 2. Not only may restraining floating piece 40 be used alone or in combination with a skin-plug as shown in FIG. 14, but the skin-strainer 2 may be used in combination with the skin-plug 18 without the interposition of a restraining floating piece 40. In such a case, a larger skin-plug 18 will be used having a greater radius of curvature r, such that the surface 45 will mate properly with spherical surface 50 on skin-strainer 2.

Figure 15:
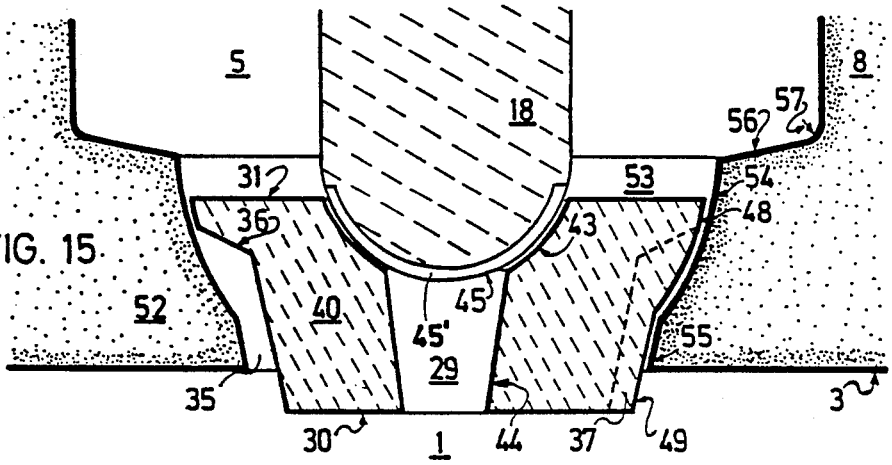
FIG. 15 is a vertical cross-section illustrating a sixth embodiment of a cover, a sixth embodiment of a restraining floating piece and further illustrating the use of a collar of the mold instead of a skin-strainer.

FIG. 15 shows a sixth embodiment of a cover, a sixth embodiment of a restraining floating piece, a further overall embodiment according to the current invention which is made possible when the top of part 8 of the mold is made of a material such as a sand mold aggregate. A skin-strainer is not present, but a strainer means is provided in the form of sprue-feeder collar 52 defining a sprue-feeder restricted passage 53, the sprue-feeder collar 52 being formed as part of the top part 8.

Because of the materials used, the aperture formed by restricted passage 53 will be larger than an aperture available in a skin strainer. Accordingly, the restraining floating piece must be correspondingly larger, but is still provided with a lateral surface having a spherical segment 48 and a conic segment 49.

The sprue-feeder collar 52 is substantially thicker than skin-strainer 2 and is provided with a spherical surface 54 and a conic surface 55. The lateral dimension of the sprue-feeder 5 also is larger. It terminates in a sloping surface 56 which is connected to a lateral wall of the sprue-feeder 5 at a radius 57 for avoiding a sharp corner.

Collar 52 is formed of a material much less resistant to the forces it will encounter than prefabricated skin-strainer 2 which, depending upon its size and on the metal poured, is typically made of ceramic, metal or a combination of the two. Accordingly, in the embodiment of FIG. 15, the collar 52 must be made sufficiently resistant and therefore is thicker than a skin-strainer and is provided with slope 56 and radius 57. However, the thicker sprue-feeder collar 52 is less advantageous for proper feeding of the casting once the mold is poured and the metal still liquid. To compensate, the aperture 53 is typically larger than that found in an embodiment such as FIG. 14. The size of the sprue-feeder 5 also is increased in order that the metal in aperture 53 solidifies later than that part of the casting which must be fed by sprue-feeder 5. It should be noted that the provision of a larger aperture 53 and larger sprue-feeder 5 imply that more molten metal must be used and more fettling work must be done.

In the embodiment of FIG. 15, the strength of collar 52 may be increased, although not easily, by using an adequate metallic reinforcing armature which can be made following known practices in the foundry molding art.

As in the embodiment of FIG. 14, the restraining floating piece may be used without the skin-plug, or a larger skin plug may be used without a restraining floating piece.

Also shown in FIG. 15 is the presence of one or more optional channels 45' on the bottom 45 of the skin-plug. This embodiment may also be used in FIG. 14. When the surface 45 comes into contact with surface 43, or surface 50 (FIG. 14), or surface 54, the channel or channels 45' allow for some molten metal to pass form the sprue-feeder 5 into the cavity 1 from the start of pouring but before the cover is lifted. The channel or channels 45' are not so large as to hinder adequate choking of the sprue-feeder.

Additional variations of the channels 45' are possible. For example, instead of being formed in surface 45 of the skin-plug, they may be formed in surfaces 43, 50 or 54 in FIGS. 14 and 15.

The restraining floating piece should be made of any material having an adequate refractoriness and a lowe density than the molten metal being poured, so that the restrainng floating piece can withstand the impact of the molten metal, erosion, temperature, the weight of the skin-strainer cover if used, and the like, and also such that the piece may float once the mold casting cavity is full. Typically, a restraining floating piece will be made of a sintered refractory material.

The sprue-feeder extender 46 and sprue-feeder expander 47 may be made of any material whose refractoriness and resistance are compatible with such applications. Typically, sprue-feeder extender 46 will be made of bonded molding sand, and may advantageously be used in combination with exothermic materials for that part of the extender which will remain in contact with the metal after the mold is poured. Sprue-feeder exapnder 47 is preferably made of sintered refractory material. Because the amount of time it will remain in contact with the molten metal will typically be very short, the expander may be reused many times.

It may be seen from the above that a characteristic of a restraining floating piece is that it floats free of an aperture in which it is disposed once its restraining function is over, thereby enlarging the effective area available for feeding the casting. There will now be described an additional embodiment of a restraining piece which does not float but remains disposed in an aperture, yet nevertheless enhances feeding. Such a piece will be called a non-floating restraining piece. If the piece 28 illustrated in FIGS. 8A and 8B were made, for example, of a material sufficiently dense that it will not float, the piece will become a non-floating restraining piece. As will be described later, additional modification may be made to the embodiment shown in FIGS. 8A and 8B to further assist in the prevention of floating.

With the non-floating restraining piece remaining in place once the mold casting cavity 1 is full, recesses 35 will fill with molten metal and form a hot reservoir or heat source around passage 29. The reservoir 35 is thermally-adjacent the passage 29, by which it is meant that the composition and structure of the non-floating restraining piece is such that the hot metal in reservoir 35 is effective to keep the metal hot in passage 29. Thus, the heat source in recess 35 achieves the desired effect that molten metal in passage 29 remains liquid for a longer period of time and, consequently, the ability of passage 29 to feed the casting is enhanced. With this enhancing, passage 29 tends to be equivalent to a substantially larger passage and closer to the aperture 6. Nevertheless, the passage 29 still retains its other advantages of facilitating choking of the sprue-feeder during pouring and further provides for easier fettling (for example, the type of metal and casting shape may allow for a sprue-feeder that can be knocked off more easily).

Additional modifications that may be made to the structures shown in FIGS. 8A and 8B to diminish the capacity for floating or otherwise improving the operation of the non-floating restraining piece include enlarging the recesses 35 inwardly toward passage 29 (which also increases the heat source), dimensioning the overall height of the piece 28 such that the passage 29 is shortened, adjusting the slopes of the wall of aperture 6 and of surface 32, eliminating the teeth 37 (which also increases the heat source), and providing a fresh refractory wash on surface 32 and on the wall of skin-strainer aperture 6 between the surface 32 and the wall of aperture 6 in order to cause surface 32 and the wall to stick together.

It may be seen that the various embodiments according to the current invention may be standardized, thereby greatly enhancing the ease of use, accuracy and confidence with which they may be used. With standardization, there may be made available to foundries variously sized, prefabricated, interchangeable and correlated skin-strainers, restraining floating pieces, non-floating restraining pieces and covers, thereby making available corresponding elements that adequately match with each other. The prefabrication and standardization also may be extended to any auxiliary means or element necessary or useful for making easier the application of those restraining means already described, or any other.

Such standardization, for example, could mean establishing: first, a unique pattern or perhaps several patterns of matching shapes between the restraining elements, which patterns could be similar to those disclosed herein or any other; second, a unique pattern or perhaps several patterns of open area shapes for the skin-strainers and the restraining pieces; third, elements permitting adequate variation of pouring rates, i.e., of open areas; and fourth, suitable sets of different sizes of, for example, skin-strainers, restraining pieces and covers. Most such patterns will be adequate for pouring any kind of metal, but some could be specialized for example for pouring steels and irons, some others for pouring aluminum alloys in particular or non-ferrous alloys in general.

The standardization also could include a consideration of using several different materials in manufacturing the various elements.

As stated above, other related elements also could be standardized and prefabricated such as sprue-feeder extenders, sprue-feeder expanders, skin-strainer cover extensions and the like.

With standardization, to every size of skin-strainer there could be one or even a group of corresponding restraining floating pieces that match with it and also one or even a group of skin-strainer covers doing the same. Similarly, one or even several covers can be associated with every restraining piece.

All of the skin-strainer covers considered in the standardization could be configured such that any skin-strainer cover of the set may be used with a corresponding skin-strainer or with a corresponding interposed restraining piece.

Of course, from all the numerous possible combination and variations among the elements, the tendency will be to prefer just a few and only those that are more versatile for standard prefabrication.

It should be pointed out that standardization permits one to establish definite preferences of some embodiments over others. For example, the embodiment shown in FIG. 14 is preferable to the one shown in FIG. 15, because the comparative thinness of a standard well-prefabricated skin-strainer 2, when compared to sprue-feeder collar 52, provides for better feeding, a smaller neck connection (i.e., a smaller aperture), a smaller sprue-feeder size and better matching of restraining means.

Figure 16:
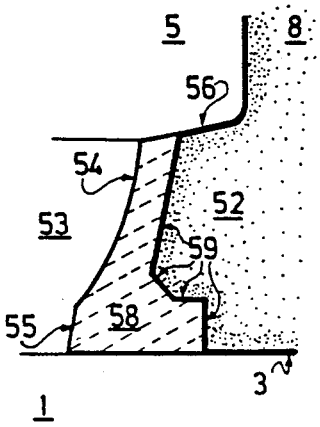
FIG. 16 is a fragmentary vertical cross-section similar to a portion of FIG. 15 and illustrating the use of a collar edge insert in addition to a collar.

Nevertheless, standardization can still provide for the improvement of the less-preferred embodiment of FIG. 15, as shown in FIG. 16. Shown in FIG. 16 is a collar edge 58 which is standardized, prefabricated and typically made of ceramic. Collar edge 58 has an aperture 53, the sidewall of which comprises spherical segment 54 and conic segment 55 which generally follow and correspond to the same surfaces of collar 52 as shown in FIG. 15. Also as shown, the collar edge 58 contains upper and lower surfaces that match with surfaces 3 and 56, forming extensions of those surfaces. Collar edge 58 has an outside back surface 59 adequate to firmly connect and support the collar edge 58 to the remaining part of the collar 52. When making the top of part 8 of the mold, the collar edge 58, for example, may be placed around the pattern for the passage 53 and underneath the pattern for the sprue-feeder 5. Molding sand will then be rammed against the casting pattern, against the collar edge 58 and against the pattern for the sprue-feeder 5.

In use, because the collar edge 58 presents surfaces 54 and 55 that are harder and smoother than the corresponding surfaces illustrated in FIG. 15, it will assure a more accurate matching with any restraining means as, for example, a skin-plug, a restraining floating piece, a non-floating restraining piece, and the like.

The gating system described in this specification is advantageously compatible with the performance of in-mold metallurgical treatments.

Such treatments, as also in the case of ladle treatments, involve the use of one or several metallurgical treatment products which must be in contact with the molten metal shortly before the molten metal reaches the mold casting cavity. It is known in the art to place such products somewhere in the filling section of a traditional gating system, usually formed by the assembly of sprues, channels and ingates, in such a way that the molten metal is automatically treated as it flows toward the mold casting cavity.

Considering by way of example the embodiment of FIG. 13, such a metallurgical treatment product or products may easily be placed on surfaces 34 or 31, or in sprue-feeder enlargement 16 on the top surface of sprue-feeder extension 46 or in a lateral chamber specially formed off of sprue-feeder 5 during the molding stage, either in the top part 8 of the mold or in sprue-feeder extender 46, or in several or all of such locations, or in any other location.

As stated above, in the type of embodiment shown in FIG. 13 it is possible to pour into sprue-feeder 5 and sprue-feeder enlargement 16 the full amount of molten metal necessary for pouring the mold, and this amount of metal may be added before the cover is lifted. Therefore, in such embodiments it is possible to adjust the timing of the lifting of the skin-plug to the completion of such metallurgical treatment, an important advantage in terms of efficiency and economy. In fact, by lifting the skin-strainer cover just in time, it is possible to avoid fading of the treatment effect as can occur in the case of ladle treatments and it is further possible to avoid insufficient treatment of molten metal as can be the case in known versions of in-mold treatment.

Figure 17:
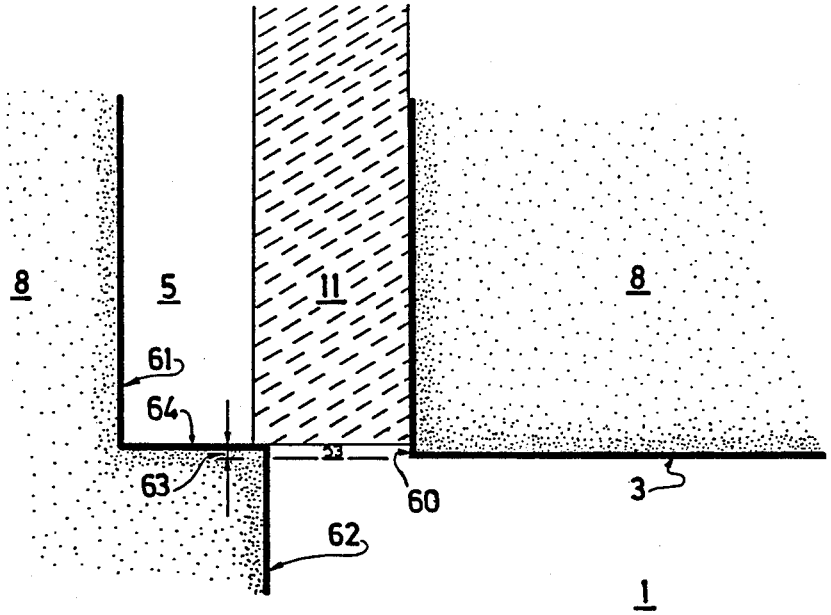
FIG. 17 is a vertical cross-section showing a sprue-feeder intersecting a mold casting cavity at an edge of the cavity such that a portion of the cross-section of the sprue-feeder communicates with the cavity through an opening and the remainder of the cross-section of the sprue-feeder is disposed in the mold beyond the cavity, the opening being closed by a cover according to the current invention.

Referring now to FIG. 17, there is shown an embodiment in which sprue-feeder 5 overlaps the mold casting cavity contour surface such that the sprue-feeder intersects the cavity 1 at an edge of the cavity and a portion of the cross-section of the sprue-feeder 5 communicates with the cavity 1 through an opening 53, the remainder of the cross-section of the sprue-feeder 5 being disposed in the mold beyond the cavity. Numeral 60 is that part of the sprue-feeder lateral wall which is in front of the cavity, and 61 is the rest of that lateral wall. There is thereby formed a partial bottom of the conduit which extends from the opening to sidewall 61 of the conduit. The level of the partial bottom immediately adjacent the opening is no lower than the level of the top 3 of the cavity surface.

The level of bottom 64, at least where that bottom is adjacent to the opening 53, is elevated above the level of the top 3 of the mold casting cavity by a distance 63, which nevertheless can be made as small as desired. Therefore, the distance 63 corresponds to the vertical dimension of an aperture 53 (or an aperture 12 in the preceding embodiments), communicating sprue-feeder 5 and mold casting cavity 1 through a single aperture. In such a case, a collar with a height equivalent to distance 63 is naturally formed. A skin-strainer also may be used having a thickness corresponding to the distance 63 for further reducing contact of the sprue-feeder with the cavity.

In the case of FIG. 17, a restraining means such as a cover 11, as shown, or a restraining floating piece or any other restraining means may be used by resting the restraining means at least partly on surfaces 64 and 60 and, if desired, allowing a portion of it to protrude into mold casting cavity 1 (not shown).

Figure 18:
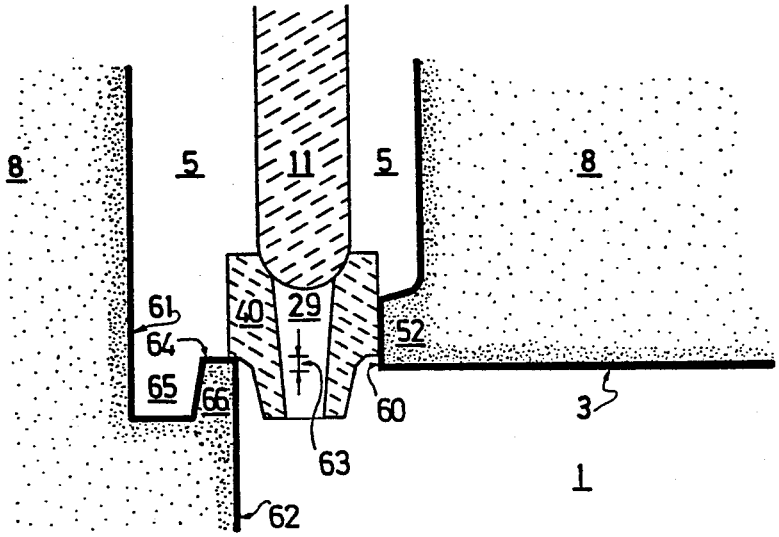
FIG. 18 is a vertical cross-section similar to FIG. 17, wherein the opening is provided with a collar, a seventh embodiment of a restraining floating piece being disposed in the opening and covered with a skin-plug.

The embodiment of FIG. 17 allows for good feeding once the mold is full, because the distance 63 can be made quite short or even reduced to zero, although good feeding is somewhat impaired by the fact that the communication between the cavity 1 and the sprue-feeder 5 is not at the center of the sprue-feeder. Accordingly, the improvement of FIG. 18 may be used according to which a depression 65 is formed in the bottom of the sprue-feeder 5, thereby creating a wall 66, and by additionally creating a portion of a collar 52, or both. The wall 66 and collar 52 become hotter in the case of FIG. 18 than in the case of similar mold parts of FIG. 17 due to the presence of molten metal in depression 65 and over collar 52, thereby improving the feeding action.

Figure 19:
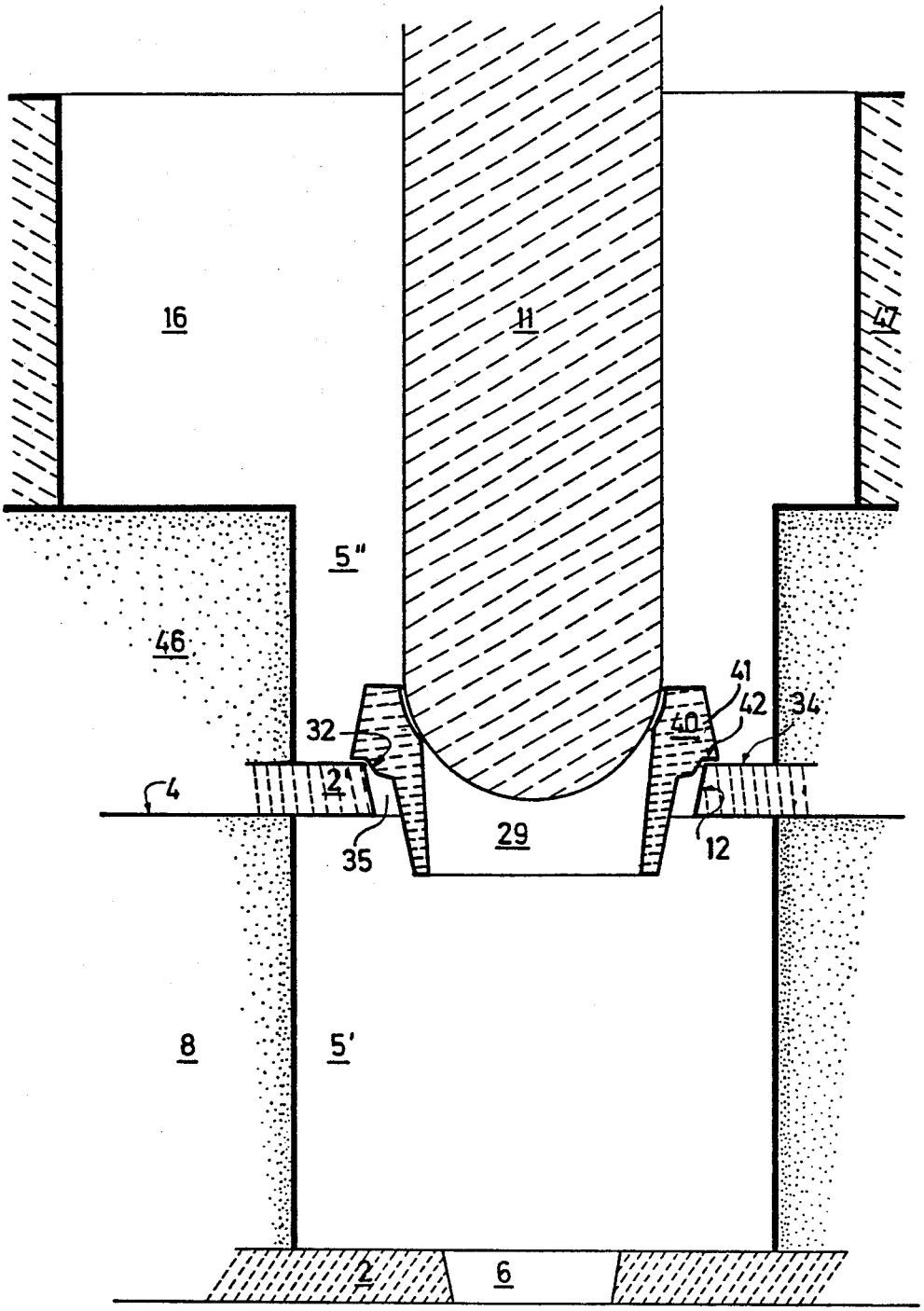
FIG. 19 is a vertical cross-section illustrating the use of two skin-strainers, an eighth embodiment of a restraining floating piece according to the current invention being disposed in an aperture of one of the skin-strainers and being covered by a skin-plug.

Referring now to FIG. 19, there is shown one example of a generic case in which a sprue-feeder terminates at a skin-strainer 2 having one or plural apertures (or, in the alternative, at a collar 52, or still without any straining means at all) and in which straining means 2' are disposed at one or even several additional locations along the length of the sprue-feeder. One such possible additional upstream location is the top surface 4 of the mold, as shown in FIG. 19. Surface 4 may be considered in this regard as analogous to the mold casting cavity surface to which the skin-strainer or collar concepts also can be applied, and consequently, the concept of restraining means.

In FIG. 19, the sprue-feeder is separated into two parts 5' and 5" by a second strainer 2' located at surface 4, sprue-feeder part 5' being located adjacent cavity 1 and sprue-feeder part 5" being disposed above strainer 2'. The strainer 2' is shown in combination with a further embodiment of a restraining floating piece 40 and a cover 11. For clarity of illustration, restraining floating piece 40 is shown elevated slightly above the position at which it will reside during pouring. This embodiment of restraining floating piece 40 has some variations of shape when compared with that of FIG. 13. Before pouring, surface 42 will rest on surface 34 for supporting the restraining floating piece 40. However, surface 32 angles inwardly so as not to be in full contact with the lateral surface of the aperture 12, thereby avoiding the possibility of a wedge effect between restraining floating piece 40 and strainer 2', which wedge effect could diminish the floatability of the restraining floating piece. The lateral extension 41 of the restraining floating piece 40 exhibits an optional alternative upward and inward taper toward the top of the restraining floating piece.

Variations of these embodiments also are possible. For example, a collar 52 may be used instead of strainer 2', or at the same location of strainer 2' there may also be used a combination of straining means with a cover without the interposition of any restraining floating piece.

If skin-strainer 2 is used and in order for proper operation, the open area of skin-strainer 2 should be less than the open area of restraining floating piece 40 such that, once cover 11 is lifted during pouring, the sprue-feeder lower part 5' will be choked, and so creating an advantage in terms of increased casting soundness of a second straining effect while filling of cavity 1 is taking place. In the alternative, and when convenient, the open area of skin-strainer 2 may be reduced by using some restraining means, for example, a restraining floating piece, which could consequently allow for a smaller effective open area of the restraining floating piece associated with strainer 2'.

If the skin-strainer 2 of FIG. 19 comprises more than one aperture, the open area may also be reduced by using at least one blind restraining floating piece.

In a further modification, the section 5" may have a somewhat greater cross-sectional area than the section 5', and strainer 2' may just stand on surface 4 of top part 8 of the mold, presenting a contour size within the limit of such increased cross-section. In such a case and by the end of the mold filling, not only will the restraining floating piece associated with strainer 2' float, but the strainer 2' could float as well if its floatability is defined in terms similar to those used for floating pieces already defined.

Still referring to FIG. 19, and still considering the case in which the cross-sectional area of 5" is somewhat greater than the section of 5', it is possible to use a restraining floating piece 40 but without any strainer interposed between the restraining floating piece and surface 4 as, in such a case, a restraining floating piece of greater lateral dimension can have surface 42 standing directly on the sprue-feeder edge of surface 4.

Going further, in the day-to-day foundry shop practice, and as already mentioned, it may be justified in some cases to avoid the straining effect at the mold casting cavity surface, by terminating the sprue-feeder 5 full-open at cavity 1. In such a case, the straining effect could be disposed at least at one upstream level such as level 4 in FIG. 19. Such a practice would have the effect, among others, of losing the efficiency of the feeding capacity because sprue-feeder part 5' would not be choked and consequently would not be as hot as it is in normal skin-strainer practice, a loss of efficiency which can somewhat be compensated for by increasing the cross-sections of the portions 5' and 5". Accordingly, a restraining means may be associated with straining means within a sprue-feeder conduit at a location independent of the mold casting cavity surface.

Today, non-metallic casting materials such as polymers have been and are being developed, and their study is being included in programs of metallurgical engineering. Foundry technology can be applied to those materials, and foundry vocabulary can be used by extension or analogy when referring to them. In particular, the invention herein disclosed also can be applied to such non-metallic casting materials, either to control only the cavity filling or to control both the cavity filling and the corresponding casting feeding, whether or not the material exhibits solidification shrinkage.

Figure 20:
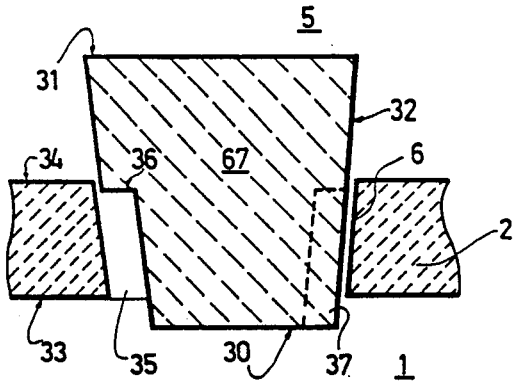
FIG. 20 is a vertical cross-section illustrating a ninth embodiment of a restraining floating piece according to the current invention, the piece being a blind restraining floating piece.

FIG. 20 shows an additional embodiment of a restraining floating piece according to the current invention. Restraining floating piece 67 is a blind restraining floating piece, so-called because neither the piece nor the aperture 6 in which the piece is disposed provides a passage communicating sprue-feeder 5 with cavity 1 while the piece remains disposed in the aperture. This embodiment is generally useful and possible with skin-strainers having more than one aperture, to still allow for filling. No molten metal passes from sprue-feeder 5 to cavity 1 through the corresponding aperture until the piece 67 floats upon the filling of cavity 1 through at least one additional aperture. The embodiment shown in FIG. 20 is like that shown in FIGS. 8A and 8B, except that there is no passage 29. However, the embodiment of FIG. 20 is representative only, and a blind restraining floating piece may be created, for example, by modifying any other embodiment of a restraining floating piece to remove the various forms of passages from sprue-feeder 5 to cavity 1.

Considering that to date porous ceramic is available and that, when in contact with molten metal, such porous ceramic allows for the molten metal to go through the porous material, which material can be called metal-permeable material, it is possible to take advantage of this property for designing and manufacturing restraining means according to the current invention. Such restraining means will restrain the flow of metal toward the cavity but will not block it completely. For example, if a blind restraining floating piece like or similar to the one shown in FIG. 20 is made of a porous ceramic material, it will not be blind any more. It will, instead, allow molten metal to pass toward the cavity and still, if conveniently shaped, it will float once the cavity is full. Such a piece can be used in combination with straining means presenting only one aperture. In the cases when the molten metal filling the porous ceramic piece and the cavity being already filled, the molten metal within the porous ceramic piece furthermore staying molten long enough to feed the casting, of course at this stage the floatability of the piece is not mandatory anymore.

Yet another type of restraining means according to the current invention is a foraminous sheet made of a refractory material. Such a sheet may be made of a metallic mesh, fiberglass mesh, carbon fiber mesh, standard open materials such as perforated metal plate, expanded metal or the like, and all refractory materials which are bought off the shelf in sheets, rolls and the like. It is intended to include all thin flexible sheets that are permeable to molten metal and made of a refractory material, it being understood that refractoriness is a relative term as previously defined. Such sheets 68 can be used as shown in FIGS. 21 and 22.

Figure 21:
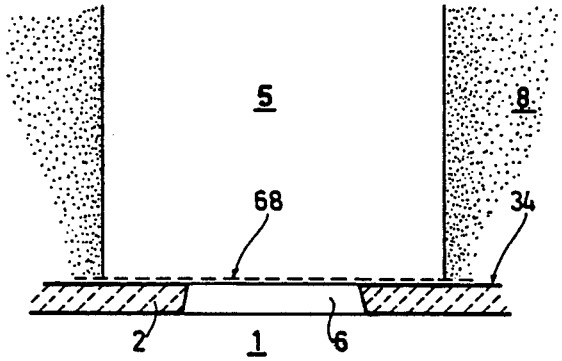
FIG. 21 is a vertical cross-section illustrating restraining means in the form of a foraminous sheet made of a refractory material, the sheet being held between a skin-strainer and the top part of a mold.

In FIG. 21, sheet 68 is placed on upper surface 34 of skin-strainer 2 in order that the combination of skin-strainer and its associated retaining means (the retaining mean not being shown for the sake of simplicity) support the sheet 68. The sheet 68 covers the skin-strainer and extends beyond the sides of conduit 5, remaining partly pressed against the material of mold 8. Skin-strainer 2 is shown with one aperture 6, but it may be provided with a plurality of apertures. Aperture 6 is shown with a reversed taper when compared with the taper of aperture 6 in, for example, FIG. 1, assuming that the mold casting cavity surface 3 is conventionally modified following the skin-strainer 2 central profile.

Obviously, sheet 68 restrains the open area of skin-strainer 2, thereby easing the choking of sprue-feeder 5, allowing filling of the cavity because of the metal permeability of the sheet 68, and feeding, when necessary, the corresponding casting because the thinness of the sheet 68 allows for the material of the sheet 68 to rapidly reach the temperature of the molten metal. Accordingly, the material of the sheet 68 does not promote early solidification and therefore does not block feeding toward the casting cavity. Such additional restraining means may naturally be called a restraining sheet 68.

Figure 22:
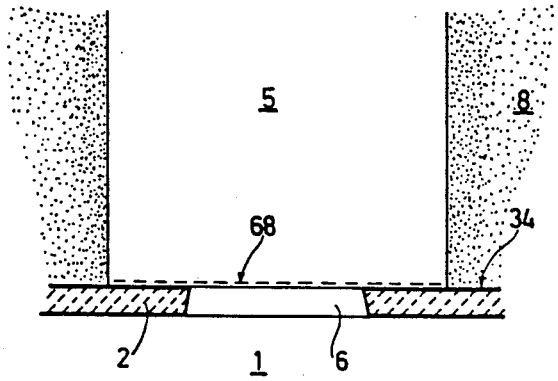
FIG. 22 is a vertical cross-section illustrating restraining means in the form of a foraminous sheet made of a refractory material, the sheet resting on a skin-strainer and having horizontal dimensions no greater than those of the sprue-feeder.

FIG. 22 is identical to FIG. 21 with the exception that the restraining sheet 68 rests freely on surface 34 of skin-strainer 2 and within the limit of the contour of conduit 5.

Depending on, for example, the size of hole 6, the flexibility of restraining sheet 68, and the like, either the situation of FIG. 21 or of FIG. 22 will be preferred, in order that sheet 68 substantially remains in its position throughout the pouring operation. As the flexbility of sheet 68 tends to increase, or as the size of aperture 6 tends to increase, or both, the situation of FIG. 21 will tend to be preferred over that of FIG. 22.

In the case of FIG. 22, if sheet 68 is lighter than molten metal, it will float at the most once cavity 1 is filled. If restraining sheet 68, in the case of FIG. 22, does not float either because it is heavy enough or because the situation corresponds to that of FIG. 21, restraining sheet 68 will remain in the same position and once the metal is soldified, the sheet 68 will weaken contact of the casting and sprue-feeder and so will ease the possibility of separating the sprue-feeder 5 by knocking it off.

As the restraining sheet 68 can be more or less flexible it can be advantageous in some cases to consider the simultaneous use of more than one layer, for example two superposed layers, placing a less flexible sheet directly on the skin-strainer and another more flexible sheet having better restraining quality on top of it.

As can be envisaged, the possibility of using restraining sheets presents a diversity of options.

It has so been clearly established that restraining means can be embodied by using materials permeable to molten metal, whether they are porous ceramics, thin flexible foraminous sheets of refractory materials, or the like.

The gating system as disclosed in U.S. Pat. No. 4,154,289 and the gating system as disclosed in the present specification primarily look, firstly, for pouring clean metal into the mold casting cavity through an easy choking of the conduit 5 and, secondly, for a complete and good filling of the mold casting cavity; complementarily and when required by casting soundness they also, thirdly, look for assuring the adequate feeding of said casting.

Generally, a feeding requirement will be present together with choking and filling though, sometimes, it might not be mandatory. For example, and as is well known in foundry practice, it could be so because the thinness of the casting promotes a rapid solidification, because the feeding is assured from another part of the casting through a traditional riser, because the feeding requirement is eliminated by the presence of chilling procedures, and the like.

Nevertheless, it is still good to keep in mind that in foundry practice it is a common fact that the gating points (points where metal enters the cavity) of any gating system tend to create "hot points" in the corresponding casting which, not infrequently, need to be specially feeded.

The fulfillment of any of those three requirements along the mold pouring and solification times depends on the resulting open areas of the gating system at the choking, filling or feeding stages. Depending on the characteristics of the casting (weight, size, shape, metal, etc.) the three requirements can be fulfilled by the same open area (this is the case as shown for example in FIGS. 1, 2 and 3, which are embodiments of the above-cited U.S. patent and is also the case when a restraining non-floating piece is used without any cover, when the case of FIG. 21 is present, etc.) or by two different open areas as is the case for example of FIGS. 4–10 and also FIG. 17, or still by three different open areas as is the case for example of FIGS. 11–15 and also FIG. 18. An embodiment of the type shown in FIG. 19 even provides the possibility of using more than three successive open areas.

The case of FIG. 20, which and as already explained in this specification is used with a strainer having at least two apertures, corresponds to a system presenting two different open areas: one for choking and filling and the other for feeding. It could also correspond to a system presenting three different open areas by associating a cover to the strainer open area not blocked by blind restraining floating means: one area for choking (which eventually can be zero), a bigger one for filling and the biggest for feeding.

In general foundry practice, it is frequent that the open area required for feeding is greater or even in some cases much greater than the area that is required for filling and, in turn, that the open area required for filling is greater or even much greater than the area required for choking. The present gating system being very compact, on one side, nevertheless still allows quite easily and efficiently, by the other, to adapt to any required diversity of consecutive open areas.

It is possible in some cases, for example when the casting presents thin and extended walls, that filling requires a greater or even a much greater open area than is necessary for feeding, if feeding is required. In such a case, plainly, the system will be reduced to a system having two open areas: one for choking (which most generally will be zero) and the other for filling, as the feeding requirement, if present, obviously will be automatically covered.

It will be easily realized by what has been shown and explained in the present specification and the drawings that other different systems may be defined presenting combinations of two and three (or even more) consecutive open areas.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being a sprue-feeder open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said gating system further comprising straining means fixed along said conduit, said straining means having aperture means forming a total passage cross-sectional area of said straining means and extending through said straining means, and restraining means, distinct from said mold and said straining means, for at least partially blocking the flow of molten metal through said aperture means of said straining means during pouring, said restraining means comprising at least one restraining floating piece of a composition and shape such that it will float when said mold is full, said restraining floating piece being disposed in an aperture of said straining means and partially but not fully blocking said aperture, thereby forming a restricted cross-sectional passage area presented by the assembly of said restraining floating piece and said straining means, said restraining floating piece being so supported that it is free to float when said mold is full, thereby increasing the effective cross-sectional area that is available for feeding the casting through the aperture in which said restraining floating piece had been disposed, said restraining floating piece being able to withstand the effects of temperature, impact, pressure and erosion resulting from the pouring of molten metal, said restraining means further comprising cover means disposed in said conduit for temporarily and further blocking at least a portion of said restricted cross-sectional passage area presented by the assembly of said straining means and said restraining floating piece, said cover means comprising meas for facilitating the choking of said conduit during pouring and further comprising means for separating the cover from the assembly of said straining means and said at least one restraining floating piece to increase said cross-sectional passage area for filling said cavity.

2. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said gating system further comprising straining means fixed along said conduit, said straining means having aperture means forming a total passage cross-sectional area of said straining means and extending through said straining means, and restraining means, distinct from said mold and said straining means, for at least partially blocking the flow of molten metal through said aperture means during pouring, said restraining means comprising at least one non-floating piece having a composition and shape such that it will not float when said cavity is full, said non-floating piece being disposed in an aperture of said straining means and partially but not fully blocking said aperture, thereby forming a restricted cross-sectional passage area presented by the assembly of said non-floating piece and said straining means, said non-floating piece comprising a recess so disposed that it will fill with molten metal, said recess comprising means for establishing a heat source of hot metal thermally adjacent the metal in said restricted cross-sectional passage area of said assembly for increasing the feeding capacity of said restricted cross-sectional passage area.

3. Apparatus according to claim 2, said restraining means further comprising cover means disposed in said conduit for temporarily and further blocking at least a portion of said restricted cross-sectional passage area presented by the assembly of said skin-strainer and said non-floating piece.

4. Apparatus according to claim 3, said cover means being disposed in contact with said skin-strainer and blocking a plurality of apertures thereof.

5. Apparatus according to claim 3, said cover means being disposed in contact with said non-floating piece.

6. Apparatus according to claim 5, said non-floating piece having a passage formed therein communicating said conduit and said cavity and forming at least a portion of said restricted cross-sectional passage area of said assembly, said cover means comprising means for at least partially blocking said passage in said non-floating piece.

7. Apparatus according to claim 6, said aperture means of said skin-strainer comprising a single aperture, said cover means being received in said passage of said non-floating piece.

8. Apparatus according to claim 7, wherein said cover means is received in said passage of said non-floating piece such that at least one channel is formed therebetween communicating said conduit and said cavity.

9. Apparatus according to claim 2, wherein said non-floating piece is made of a metal-permeable refractory material.

10. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said gating system further comprising straining means fixed along said conduit, said straining means having aperture means forming a total passage cross-sectional area of said straining means and extending through said straining means, and restraining means, distinct from said mold and said straining means, for at least partially blocking the flow of molten metal through said aperture means of said straining means during pouring, said restraining means comprising a cover means disposed in contact with said straining means for temporarily blocking at least a portion of said total passage cross-sectional area of said straining means for facilitating the choking of said conduit during pouring, said cover means comprising at least one positioning surface cooperating with a lateral wall of said aperture means of said straining means to keep said cover means in place during pouring.

11. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said gating system comprising a collar integrally formed of the material of said mold and interposed between said conduit and said cavity such that a surface of said collar is a surface of said cavity, there being an aperture communicating said conduit and said cavity at the location of said collar, restraining means, distinct from said mold, for at least partially blocking the flow of molten metal through said aperture during pouring, and a collar edge insert distinct from said mold and said restraining means, said collar supporting said collar edge insert, said aperture passing through said collar edge insert.

12. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being a sprue-feeder open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said gating system further comprising straining means fixed along said conduit, said straining means having aperture means forming a total passage cross-sectional area of said straining means and extending through said straining means, and restrainaing means, distinct from said mold and said straining means, for at least partially blocking the flow of molten metal through said aperture means of said straining means during pouring, said restraining means comprising at least one restraining floating piece of a composition and shape such that it will float when said mold is full, said restraining floating piece being received within an aperture of said straining means and partially but not fully blocking said aperture, thereby forming a restricted cross-sectional passage area presented by the assembly of said restraining floating piece and said straining means, said restraining floating piece being laterally restrained by said straining means such that said straining means will prevent displacement of said restraining floating piece by forces of metal passing through said sprue-feeder toward the casting cavity, said restraining floating piece being so supported that it is free to float when said mold is full, thereby increasing the effective cross-sectional area that is available for feeding the casting through the aperture in which said restraining floating piece had been disposed, said aperture of said straining means and said restraining floating piece having lateral surfaces that are opposed when said restraining floating piece is disposed within said aperture, portions of said opposed surfaces being spaced apart to create therebetween recess means extending toward said cavity and opening toward said cavity at a lower surface of said straining means for the reception of metal rising from below during filling.

13. Apparatus according to claim 12, said restraining means additionally comprising cover means disposed in said conduit for temporarily and further blocking at least a portion of said restricted cross-sectional passage area presented by the assembly of said straining means and said restraining floating piece.

14. Apparatus according to claim 13, said cover means being disposed in contact with said straining means and blocking a plurality of apertures thereof.

15. Apparatus according to claim 13, said cover means being disposed in contact with said restraining floating pieces.

16. Apparatus according to claim 15, said restraining floating piece having passage formed therein forming at least a portion of said restricted cross-sectional passage area of said assembly of said straining means and said restraining floating piece, said cover means comprising means for at least partially blocking said passage in said restraining floating piece.

17. Apparatus according to claim 16, said aperture means of said straining means comprising a single aperture, said cover means being received in said passage of said restraining floating piece.

18. Apparatus according to claim 17, wherein said cover means is received in said passage of said restraining floating piece such that at least one channel is formed therebetween for the passage of metal toward said cavity.

19. A gravity poured foundry mold having a gating system and at least one complere mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being a sprue-feeder open on opposite ends thereof and extending directly from an outer surface of said mold to a surface of said cavity, said conduit comprising means for receiving molten metal and guiding said molten metal directly toward said cavity such that, during poruing, all molten metal passing through said conduit flows directly toward said cavity, said gating system further comprising straining means fixed along said conduit, said straining means having aperture means forming a total passage cross-sectional area of said straining means and extending through said straining means, and restraining means, distinct from said mold and said straining means, for at least partially blocking the flow of molten metal through said aperture means of said straining means during pouring, said restraining means comprising a cover means disposed in contact with said straining means for temporarily blocking at least a portion of said total passage cross-sectional area of said straining means, said straining means and said cover means comprising means for facilitating the choking of said sprue-feeder during pouring, said cover means being removable from its position of contact with said staining means to provide for filling of the cavity and for feeding of the casting from said conduit through said aperture means of said straining means.

20. Apparatus according to claim 19, said cover means comprising at least one positioning surface cooperating with a lateral wall of said aperture means of said straining means to keep said cover means in place during filling.

21. Apparatus according to claim 10, said cover means further comprising:

a standard and prefabricated body made of refractory material, said at least one positioning surface being formed thereon, there being a recess on an underside of said body and a hole extending along the length of said body and communicating with said recess;

a standard as prefabricated auxiliary metallic bar having a head at one end therof and a fillet at the other end thereof, said bar being disposed in said hole such that said head is disposed in said recess;

standard and prefabricated tightening means affixing said bar to said body, wherein said bar comprises lifting means; and a refractory auxiliary mix filling the remaining space in said recess, covering when necessary said head of said bar and matching the external contour of said body.

22. Apparatus according to claim 21, said cover means further comprising at least one standard and prefabricated auxiliary cover extension, made of a refractory material and having an extension hole extending along the length thereof, said metallic bar extending through said extension hole.

23. Apparatus according to claim 20, wherein said aperture means of said straining means comprises a single aperture, said positioning surface of said cover means being disposed therein.

24. Apparatus according to claim 23, said positioning surface mating with a wall of said aperture such that at least one channel is formed therebetween for the passage of metal toward said cavity.

25. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said gating system comprising a collar integrally formed of the material of said mold and interposed between said conduit and said cavity such that a surface of said collar is a surface of said cavity, there being a single aperture communicating said conduit and said cavity at the location of said collar, and restraining means, distinct from said mold, for at least partially blocking the flow of molten metal through said aperture during pouring, said restraining means comprising a cover means removably disposed within said aperture, there being matching surfaces on said cover means and on an aperture-defining surface of said collar for seating said cover means in said aperture.

26. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being a sprue-feeder open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said gating system comprising a collar integrally formed of the material of said mold and interposed between said conduit and said cavity such that a surface of said collar is a surface of said cavity, there being a single aperture communicating said conduit and said cavity at the location of said collar, and restraining means, distinct from said mold, for at least partially blocking the flow of molten metal through said aperture during pouring, said restraining means comprising a restraining floating piece of a composition and shape such that it will float when said cavity is full, said restraining floating piece being received within said aperture and partially but not fully blocking said aperture, there being a passage formed in said restraining floating piece for communicating said conduit with said cavity, said restraining floating piece being so supported that it is free to float when said cavity is full, thereby increasing the effective cross-sectional area that is available for feeding the casting through the aperture in which said restraining floating piece had been disposed, said restraining means further comprising removable cover means disposed in said conduit and in contact with said restraining floating piece for temporarily and at least partially blocking said passage formed in said restraining floating piece, said cover means facilitating the choking of said conduit during pouring.

27. A gravity poured foundry mold having a gating system and at least one complete mold casting cavity, said casting cavity being distinct from said gating system and corresponding to an entire casting to be produced by that mold, said gating system being disposed within and forming part of said mold, said gating system establishing necessary flow paths between an open outside of the mold and said cavity, said gating system comprising at least one conduit forming one of said flow paths, said conduit being open on opposite ends thereof and extending directly from an outer surface of said mold to a surface of said cavity, said conduit comprising means for receiving molten metal and guiding said molten metal directly toward said cavity such that, during pouring, all molten metal passing through said conduit flows directly toward said cavity, said conduit intersecting said cavity at an edge of said cavity such that a portion of the cross-section of said conduit communicates with said cavity through an opening and the remainder of the cross-section of said conduit is disposed in said mold beyond said cavity such that a partial bottom of said conduit is formed and extends from said opening to a sidewall of said conduit, the level of said partial bottom immediately adjacent said opening being no lower than the level of said cavity surface, and restraining means distinct from said mold for at least partially blocking the flow of molten metal through said opening during pouring, said restraining means so comprising means, firstly, facilitating the choking of said conduit during pouring and also assuring the adequate condition for, secondly, filling the cavity and, thirdly, and when necessary for also feeding the casting, formed in said cavity, through said aperture means and after said cavity has been filled.

28. Apparatus according to any one of claims 1, 10, 27, 13, 19, 25 or 26, wherein said cover means is made of a metal-permeable refractory material.

29. Apparatus according to any one of claims 1, 12 or 26, wherein said restraining floating piece is made of a metal-permeable refractory material.

30. Apparatus according to any one of claims 1, 2, 10, 12 or 19, wherein:

said aperture means comprises at least two apertures, and said restraining means additionally comprises at least one blind floating piece of a composition and shape such that it will float, there being a blind floating piece disposed in and entirely closing at least one of said apertures, each said blind floating piece being supported such that it will not move substantially upon initial pouring of molten metal into said conduit but is free to float, thereby permitting feeding of the casting through each aperture that had been closed by each blind floating piece, each blind floating piece being able to withstand the effects of temperature, impact, pressure and erosion resulting from the pouring of molten metal.

* * * * *